US012578158B1

(12) United States Patent
Kloepfer et al.

(10) Patent No.: US 12,578,158 B1
(45) Date of Patent: Mar. 17, 2026

(54) SYSTEMS AND TECHNIQUES FOR IDENTIFYING GUN EVENTS

(71) Applicant: Biofire Technologies Inc., Broomfield, CO (US)

(72) Inventors: Kai Thorin Kloepfer, Denver, CO (US); Benjamin William Dwyer, Golden, CO (US); Jack Hugo Thiesen, Firestone, CO (US); Christopher James Owens, Denver, CO (US)

(73) Assignee: Biofire Technologies Inc., Broomfield, CO (US)

( * ) Notice: Subject to any disclaimer, the term of this patent is extended or adjusted under 35 U.S.C. 154(b) by 70 days.

(21) Appl. No.: 18/591,264

(22) Filed: Feb. 29, 2024

Related U.S. Application Data

(63) Continuation of application No. 17/822,921, filed on Aug. 29, 2022, now Pat. No. 11,920,881.

(60) Provisional application No. 63/237,717, filed on Aug. 27, 2021.

(51) Int. Cl.
*F41A 19/01* (2006.01)
*F41A 17/06* (2006.01)

(52) U.S. Cl.
CPC ..... *F41A 19/01* (2013.01); *F41A 17/06* (2013.01)

(58) Field of Classification Search
CPC ..... F41A 19/01; F41A 17/06
USPC ..... 42/84
See application file for complete search history.

(56) References Cited

U.S. PATENT DOCUMENTS

| | | | | |
|---|---|---|---|---|
| 11,156,420 | B1 * | 10/2021 | Clark | F41C 23/16 |
| 11,920,881 | B1 * | 3/2024 | Kloepfer | F41A 19/01 |
| 2009/0277065 | A1 * | 11/2009 | Clark | F41A 19/01 42/1.03 |
| 2010/0196859 | A1 * | 8/2010 | Saugen | F41G 1/02 434/11 |
| 2012/0297654 | A1 * | 11/2012 | Williams | F41A 17/063 42/1.01 |
| 2020/0109905 | A1 * | 4/2020 | Black | G08B 13/2448 |
| 2020/0348098 | A1 * | 11/2020 | Galie | F41A 19/59 |
| 2022/0214127 | A1 * | 7/2022 | French | F41A 19/16 |
| 2023/0038950 | A1 * | 2/2023 | Abreo | H04L 9/32 |

FOREIGN PATENT DOCUMENTS

| | | | | |
|---|---|---|---|---|
| DE | 4417545 | A1 * | 11/1995 | F41A 19/01 |
| WO | WO-2022238997 | A1 * | 11/2022 | F41A 17/46 |

* cited by examiner

*Primary Examiner* — Samir Abdosh
(74) *Attorney, Agent, or Firm* — Perkins Coie LLP; Andrew T. Pettit

(57) ABSTRACT

The present disclosure provides systems and techniques for identifying gun events. A gun event may include a nominal event, such as the discharging of a projectile or the ejecting of a cartridge shell, or an anomalous event, such as a misfire or a failure to feed. An apparatus may include a sensor that measures motion of a gun along multiple axes. The apparatus may identify a gun event based on the measured motion of the gun satisfying a motion condition. The motion condition may include an acceleration threshold value, and the measured motion of the gun may satisfy the motion condition based on a measured acceleration value exceeding the threshold acceleration value. The apparatus may transmit an electrical signal based on the measured motion of the gun satisfying the motion condition. The electrical signal may reset a charging circuit, increment a shot count, or decrement a round count.

14 Claims, 14 Drawing Sheets

100

200

300

800

1000

1100

1300

1400

SYSTEMS AND TECHNIQUES FOR IDENTIFYING GUN EVENTS

CROSS-REFERENCE TO RELATED APPLICATIONS

This application is a continuation of U.S. patent application Ser. No. 17/822,921, titled "SYSTEMS AND TECHNIQUES FOR IDENTIFYING GUN EVENTS" and filed Aug. 29, 2022, now U.S. Pat. No. 11,920,881, which claims the benefit of priority to U.S. Provisional Application No. 63/237,717, titled "TECHNIQUES FOR IDENTIFYING GUN EVENTS" and filed on Aug. 27, 2021, which are incorporated by reference herein in their entireties.

FIELD OF TECHNOLOGY

The teachings disclosed herein generally relate to guns, and more specifically to systems and techniques for identifying gun events.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns use compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic firearms, but also electroshock weapons, light-gas guns, plasma guns, and the like.

Significant energies have been spent developing safer ways to use, transport, store, and discard guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems and techniques described herein support identifying gun events. The term "gun," as used herein, may be used to refer to a lethal force weapon, such as a pistol, a rifle, a shotgun, a semi-automatic firearm, or an automatic firearm; a less-lethal weapon, such as a stun-gun or a projectile emitting device; or an assembly of components operable to selectively discharge matter or charged particles, such as a firing mechanism.

Generally, the systems and techniques described herein provide for the identifying of gun events, such as nominal gun events (e.g., discharging a projectile, ejecting a cartridge, etc.) and anomalous gun events (e.g., a misfire, a feeding jam, a malfunction, etc.). Aspects of the techniques described herein include measuring, at a sensor coupled with a gun, motion of the gun with respect to multiple axes, identifying a gun event based on the measured motion of the gun satisfying a motion condition, where the motion condition includes an acceleration threshold, and transmitting an electrical signal based on the measured motion of the gun satisfying the motion condition. The gun may store an indication of the gun event based on the motion condition being satisfied, where the indication of the gun event corresponds to an indication of a nominal gun event or an indication of an anomalous gun event. The gun event may be identified based on the motion condition being satisfied and/or based on a firing event, such as a trigger break. For example, the gun event may be identified based on the sensor measuring an acceleration value that exceeds an acceleration threshold within a time duration of the firing event. The transmitted electrical signal may indicate the gun event, reset a charging circuit, or transition the gun to an inactive state (e.g., a safe state).

Figure 1:
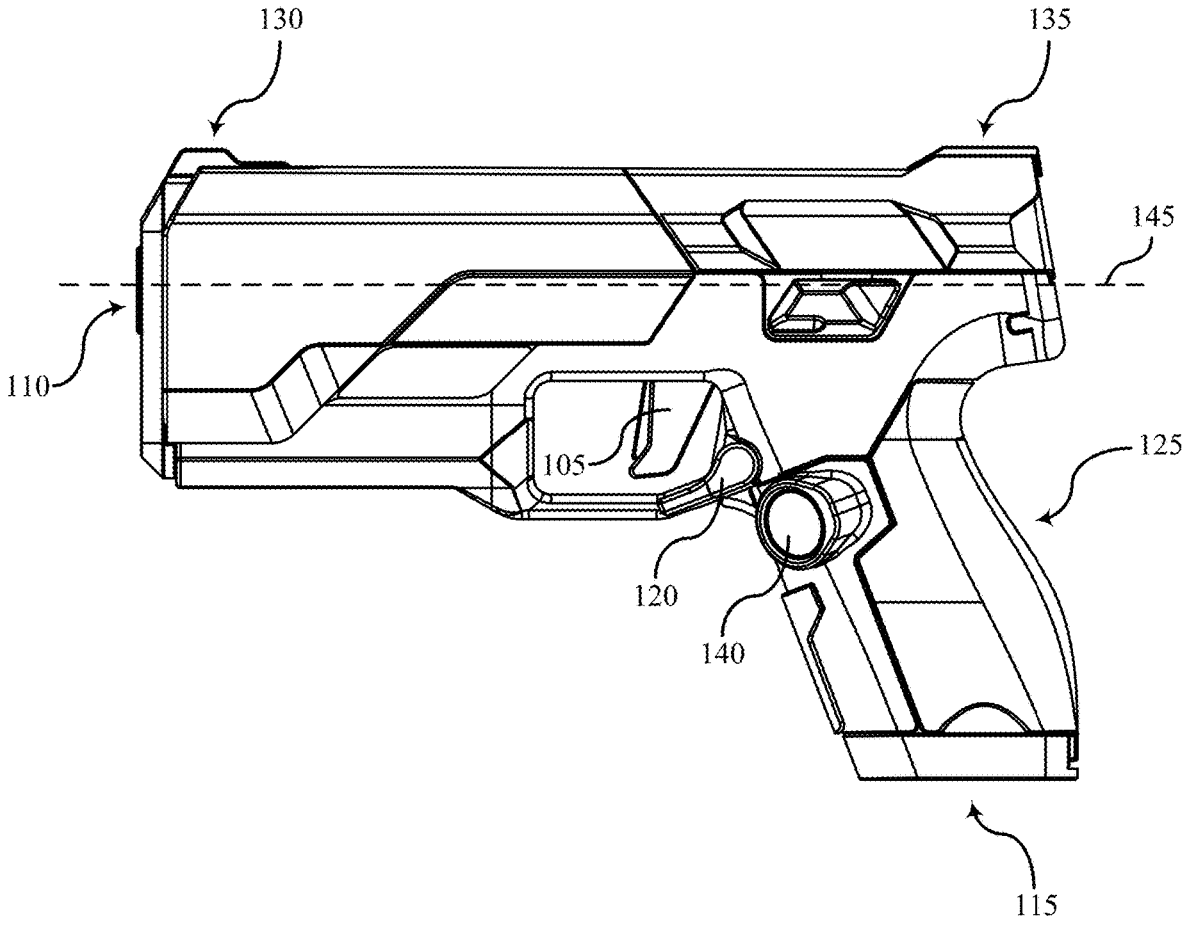
FIG. 1 illustrates an example of a gun that supports identifying events.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

Conventional guns lack the ability to detect when the gun is fired. Some conventional guns include a magazine that is designed to visually indicate the number of rounds that are inside the magazine, but this requires the user to remove the magazine from the gun to see how many cartridges (also referred to as "rounds") are present in the magazine, and this does not help the gun to determine when the gun is fired. For example, the magazine of some conventional guns includes apertures on the side of the magazine that provide a window into the magazine to visually indicate the number of rounds that are present inside the magazine. However, this type of conventional system for showing the number of rounds that are present in the magazine is purely mechanical and lacks the ability to be integrated into an electronic system.

Various aspects of the present disclosure provide systems and techniques for identifying gun events, such as the nominal discharge of a projectile and the anomalous discharge of a projectile. A weapon, such as a gun, may include a sensor (e.g., an inertial measurement unit (IMU)) that measures motion of the weapon (e.g., in terms of linear acceleration, angular acceleration, etc.), a processor that determines whether the measured motion is representative of a gun event (or simply "event"), and a barrel through which a projectile is propelled. The weapon may store a data signature in memory, and the data signature may correspond to expected movement of the gun for a given event. The gun may store multiple data signatures in memory, and the gun may identify a gun event based on data measured by the sensor matching a stored data signature. For example, the memory may contain a first data signature representing a nominal discharge of a projectile, a second data signature representing squib load malfunction, and a third data signature representing a failure to eject malfunction. The processor may identify a nominal gun event based on the measured motion of the gun matching the first data signature, and the processor may identify an anomalous gun event based on the measured motion of the gun matching the second data signature.

The gun may identify a nominal discharge of a projectile based on movement measurements matching a data signature representing expected movement of the gun during a nominal discharge of a projectile. For example, by comparing movement measurements to the data signature in an ongoing manner, the processor may be able to determine when one or more movement measures are indicative of a nominal discharge. Note that the data signature could be representative of a single value that serves as a threshold (e.g., an upper threshold or lower threshold), or the data signature could be representative of multiple values that define a pattern. Similarly, the gun may identify an anomalous discharge of a projectile based on the movement measurements matching a data signature representing expected movement of the gun during an anomalous discharge of a projectile. Measured movement of the gun may match a data signature when the measured movement and the data signature satisfy a similarity condition. Measured movement and a data signature may satisfy a similarity condition based on a measured value being greater than a threshold value of the data signature, a measured value being less than a threshold value of the data signature, a measured value being within a predetermined range of a threshold value of the data signature, multiple measured values satisfying multiple threshold values of the data signature, or any combination thereof.

In some examples, the gun may identify an anomalous discharge of a projectile based on a time duration elapsing following a firing event (e.g., a trigger break or a trigger signal) or a motion event (e.g., a first acceleration along a first axis). In other words, the gun may expect a nominal discharge of a projectile within a period of time following a firing event or a motion event, and the gun may identify an anomalous discharge of a projectile based on the period of time elapsing prior to the occurrence of a nominal discharge event.

The data signature may include one or more acceleration thresholds, and the gun may identify a nominal discharge based on the sensor measuring acceleration that satisfies the one or more acceleration thresholds, where the acceleration is measured within a time duration (e.g., 10 milliseconds, 100 milliseconds, or anywhere in between) of a first event (e.g., a firing event or a motion event). The gun may identify an anomalous discharge based on the sensor not measuring acceleration that satisfies the one or more acceleration thresholds within the time duration. In some examples, the data signature may include an additional threshold, such as an orientation threshold or a location threshold, and the gun may identify a nominal discharge based on the gun determining that multiple thresholds are satisfied.

In some examples, the data signature may be generated by firing a projectile from the gun and measuring movement (e.g., acceleration along one or more axes) of the gun, and the data signature may be stored in multiple guns of similar characteristics, such as guns that are of the same model, caliber, weight, geometry, etc. In some other examples, the data signature may be generated by firing a projectile from the gun and measuring movement of the gun, and the data signature may be stored in the gun that fired the projectile. In other words, a data signature may be deployed to only the gun that was used to generate the data signature, or the data signature may be deployed to multiple guns that possess similar characteristics.

In some examples, a data signature may be generated based on a computer program that models firing a projectile from a gun and produces movement data based on attributes, such as the weight of the gun, the caliber of the gun, the amount or type of cartridge powder, the weight of the bullet, the size of the user of the gun, the strength of the user of the gun, etc. A data signature may include values for linear motion and/or rotational motion. For example, the data signature may include a threshold value for linear acceleration along a first axis and a threshold value for angular acceleration about a second axis. The data signature may also include values for linear velocity, angular velocity, orientation, location, stability, or any combination thereof.

The gun may perform one or more actions in response to identifying a gun event. In some examples, the gun may store an indication of the number of nominal gun events in memory (e.g., how many shots have been fired), and the gun may produce an alert in response to anomalous gun events, such as a misfire. The gun may update (e.g., decrement) a count indicating the number of rounds present in the gun based on identifying a nominal gun event (e.g., a gunshot), and the gun may produce an audible alert and/or visual alert based on identifying an anomalous gun event (e.g., a misfire). In response to the gun event, the gun may transit an electrical signal (e.g., an interrupt) indicating the gun event to a processor, transit an electrical signal to reset a charging circuit (e.g., in response to a nominal event), or transmit an electrical signal to deactivate the firing system (e.g., in response to an anomalous event). In other words, in response to identifying a gun event, the gun may update a count of the number of rounds that have been fired, update a count of the number of rounds present in the gun, reset an electronic fire control system, or deactivate the electronic fire control system.

Embodiments may be described in the context of executable instructions for the purpose of illustration. For example, a processor housed in a gun may be described as being capable of executing instructions that permit the identification of events, such as nominal gun events or anomalous gun events. However, those skilled in the art will recognize that aspects of the technology could be implemented via hardware, firmware, or software.

Terminology

References in the present disclosure to "an embodiment" or "some embodiments" means that the feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, electrical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Managers are typically functional components that generate one or more outputs based on one or more inputs. A computer program may include or utilize one or more managers. For example, a computer program may utilize multiple managers that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably herein.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 that includes systems and techniques for identifying events, such as nominal gun events and anomalous gun events. The gun 100 includes a trigger 105, a barrel 110, a magazine 115, and a magazine release 120. While these components are generally found in firearms, such as pistols, rifles, and shotguns, those skilled in the art will recognize that the technology described herein may be similarly appliable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to contact a firing pin, percussion cap, or primer, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use. The gun 100 may include one or more mechanical safeties, such as a trigger safety or a firing pin safety. The trigger safety may be incorporated in the trigger 105 to prevent the trigger 105 from moving in response to lateral forces placed on the trigger 105 or dropping the gun. The term "lateral forces," as used herein, may refer to a force that is substantially orthogonal to a central axis 145 that extends along the barrel 110 from the front to the rear of the gun 100. The firing pin safety may block the displacement path of the firing pin until the trigger 105 is pulled. Additionally or alternatively, the gun 100 may include one or more electronic safety components, such as an electronically actuated drop safety. In some cases, the gun 100 may include both mechanical and electronic safeties to reduce the potential for an accidental discharge and enhance the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an IMU configured to identify a presence event in response to measuring movement that matches a movement signature of a user picking up the gun 100. As another example, the gun 100 may include an audio input mechanism (e.g., a transducer implemented in a microphone) that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint scanner (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may include one or more components that facilitate the collection and processing of token data. For example, the gun 100 may include an integrated circuit (also referred to as a "chip") that facilitates wireless communication. The chip may be capable of receiving a digital identifier, such as a Bluetooth® token or a Near Field Communication (NFC) identifier. The term "authentication data" may be used to described data that is used to authenticate a user. For example, the gun 100 may collect authentication data from the user to determine that the user is authorized to operate the gun 100, and the gun 100 may be unlocked in based on determining that the user is authorized to operate the gun 100. Authentication data may include biometric data, token data, or both. Authentication data may be referred to as enrollment data when used to enroll a user, and authentication data may be referred to as query data when used to authenticate a user. In some examples, the gun may transform (e.g., encrypt, hash, transform, encode, etc.) enrollment data and store the transformed enrollment data in memory (e.g., non-volatile memory) of the gun, and the gun may discard or refrain from storing query data in the memory. Thus, the gun 100 may transform authentication data, so as to inhibit unauthenticated use even in the event of unauthorized access of the gun.

The gun 100 may support various types of aiming sights (or simply "sights"). At a high level, a sight is an aiming device that may be used to assist in visually aligning the gun 100 (and, more specifically, its barrel 110) with a target. For example, the gun 100 may include iron sights that improve aim without the use of optics. Additionally or alternatively, the gun 100 may include telescopic sights, reflex sights, or laser sights. In FIG. 1, the gun 100 includes two sights-namely, a front sight 130 and a rear sight 135. In some cases, the front sight 130 or the rear sight 135 may be used to indicate gun state information. For example, the front sight 130 may include a single illuminant that is able to emit light of different colors to indicate different gun states. As another example, the front sight 130 may include multiple illuminants, each of which is able to emit light of a different color, that collectively are able to indicate different gun states. One example of an illuminant is a light-emitting diode (LED).

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other cases the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

The gun 100 may include a system for identifying gun events, or the gun 100 may be coupled with a system for identifying gun events. In some examples, the system may be embedded in the gun 100, while in some other examples, the system may be affixed to the gun 100. For example, the system may be located on a circuit board embedded in the gun 100, or the system may be located within a device that is affixed to a picatinny rail of the gun 100. A system for identifying gun events may include a sensor (e.g., an IMU, an accelerometer, a gyroscope, a magnetometer, etc.), a processor (e.g., a microcontroller, a digital signal processor (DSP), etc.), and memory (e.g., volatile memory or non-volatile memory). A gun event may include a nominal event, such as the discharging of a projectile or the ejecting of a cartridge shell, or an anomalous event, such as a misfire or a failure to feed.

The system for identifying gun events may include a sensor that measures motion of the gun 100 along multiple axes. The system may identify a gun event based on the measured motion of the gun 100 satisfying a motion condition. The motion condition may include an acceleration threshold value, and the measured motion of the gun 100 may satisfy the motion condition based on a measured acceleration value exceeding the threshold acceleration value. The system may transmit an electrical signal based on the measured motion of the gun 100 satisfying the motion condition. The electrical signal may reset a charging circuit, increment a shot count, or decrement a round count.

Figure 2:
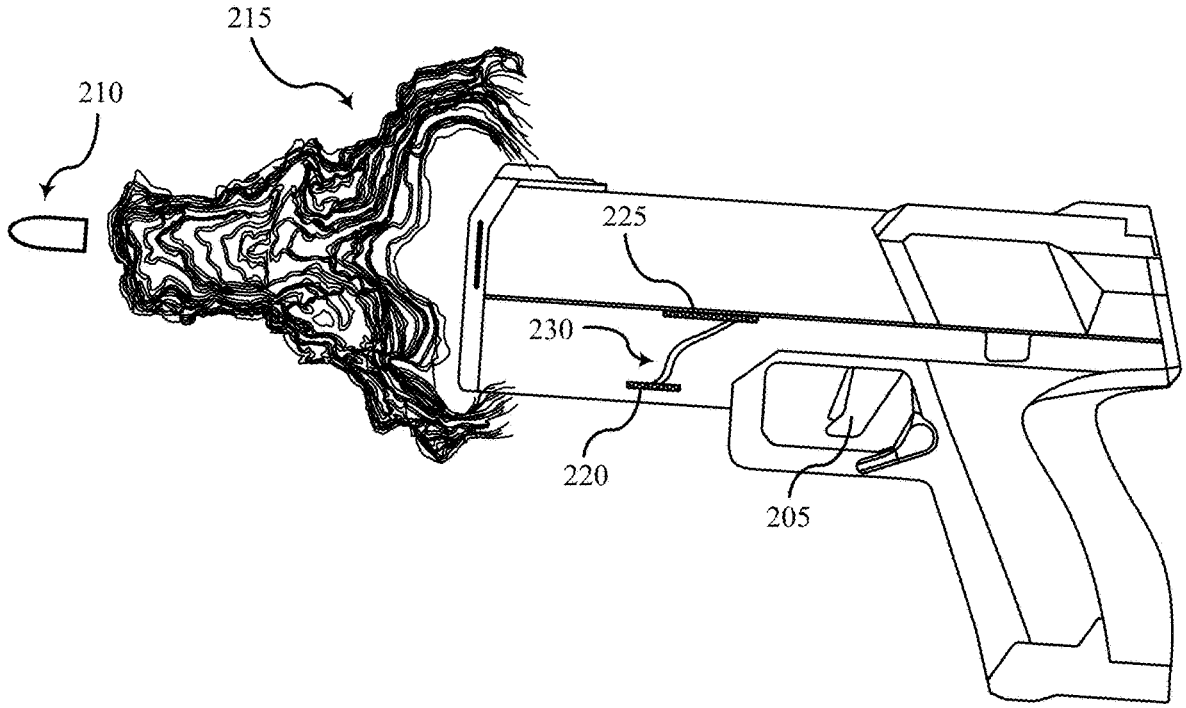
FIG. 2 illustrates an example of a gun firing a projectile.

FIG. 2 illustrates an example of a gun 200 firing a projectile 210. The firing of the projectile 210 may be an example of a nominal gun event. The gun 200 may be an example of the gun 100 as described with reference to FIG. 1.

The gun 200 may discharge the projectile 210 (e.g., a bullet), and the sensor 220 (e.g., an IMU) may measure and/or record movement of the gun 200 that is responsive to firing the projectile 210. For example, a user may pull the trigger 205 and cause combustion of a cartridge primer (via chemicals sensitive to shock or electric pulse), which ignites the main propellent of the cartridge and expels gas 215, causing a rapid increase in chamber pressure and forcing the projectile 210 through the barrel of the gun 200. The pressure decreases as the gas 215 and the projectile 210 exit the barrel. The gun 200 may move (e.g., experience recoil) in response to firing the projectile 210, and the sensor 220 may measure the movement of the gun 200. The gun 200 may move in a characteristic fashion based on attributes of the gun 200 and attributes of the cartridge, and the sensor 220 and/or processor 225 may determine if the measured movement matches (e.g., satisfies a similarity condition) a data signature. A data signature may include an acceleration value threshold and/or a velocity value threshold, and measured movement of the gun 200 may match the data signature based on the sensor 220 outputting a measurement that is within a range (e.g., within 1%, within 15%, etc.) of the acceleration value threshold and/or the velocity value threshold of the data signature. The data signature may be stored in memory of the sensor 220, memory of the processor 225, or memory of the gun 200. The memory may be volatile memory or non-volatile memory.

The sensor 220 may be coupled with the processor 225 via a communication channel 230 (e.g., a bus). The sensor 220 and/or the processor 225 may be directly or indirectly coupled with memory. For example, the gun 200 may include non-volatile memory that stores a data signature representing the nominal discharge of a projectile, and the data signature may be loaded into volatile memory of the sensor 220 and/or processor 225 to facilitate a procedure for determining whether the similarity condition is satisfied. As another example, the data signature may be loaded into memory of the sensor 220. The sensor 220 may be configured with one or more threshold values (e.g., an acceleration threshold, a velocity threshold, an orientation threshold, etc.), and the sensor 220 may transmit an interrupt signal to the processor 225 based on the one or more threshold values being satisfied. An indication of a gun event (e.g., the nominal discharge of a projectile or the anomalous discharge of a projectile) may be stored in the memory. If the gun 200 identifies an anomalous discharge of a projectile, the gun 200 may store gun state information in the memory, thereby improving users' ability to identify, resolve, and prevent malfunctions.

In some examples, the gun 200 may identify a gun event in response to identifying a first event (e.g., a motion event or a firing event) and a second event (e.g., a motion event or a timer event). For example, a nominal gun event may be identified based on a motion event (e.g., motion of the gun that is responsive to the firing of a projectile, a recoil event, etc.) occurring within a time duration of a firing event (e.g., a trigger break, a trigger signal, motion that's indicative of trigger movement, etc.). As another example, a nominal gun event may be identified based on a first motion event (e.g., satisfying a first linear acceleration threshold along a first axis, a gesture, etc.) occurring within a time duration of a second motion event (e.g., satisfying a second linear acceleration threshold along a second axis, satisfying an angular acceleration threshold about the second axis, etc.). An acceleration threshold may include a threshold magnitude and/or a threshold direction.

A gun event may be identified based on a firing event, one or more motion events, or a time difference between events. For example, the gun may identify a nominal gun event based on a motion event (e.g., measured acceleration satisfying an acceleration threshold) occurring within a time duration (e.g., 10 ms, 100 ms, or anywhere in between) of a first event (e.g., a firing event or an event), and the gun may identify an anomalous gun event based on the time duration elapsing. In other words, the gun 200 may identify a gun event based on a first event (e.g., a firing event or a motion event), and the gun event may be identified as nominal based on a second event (e.g., matching measured data to a data signature, satisfying one or more acceleration thresholds, etc.) occurring within a time duration of the first event, while the gun event may be identified as anomalous based on the time duration elapsing prior to identifying a second event.

Figure 3:
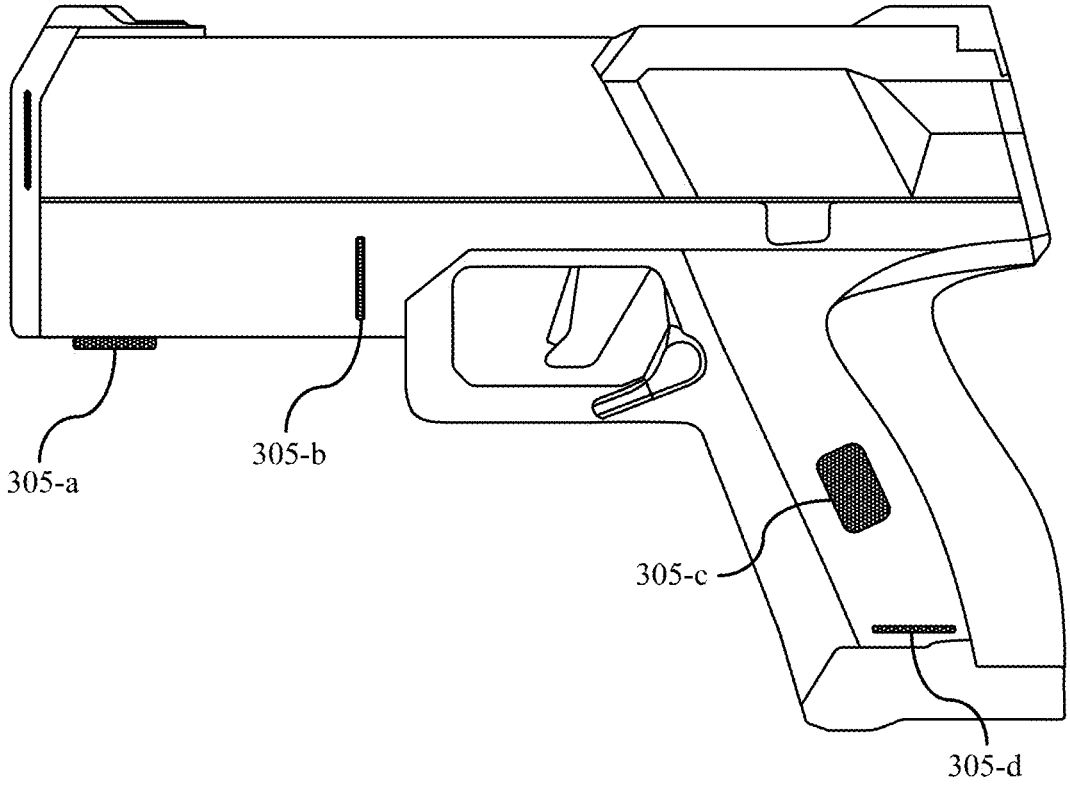
FIG. 3 illustrates an example of a gun including sensors that support identifying events.

FIG. 3 illustrates an example of a gun 300 that includes multiple sensors for identifying gun events. The gun 300 includes four sensors, but it should be understood that a gun may include additional sensors or fewer sensors. It should also be understood that a sensor may be embedded in the gun 300, or a sensor may be embedded in a device that is affixed to the gun 300. For example, a device including a system for identifying gun events may be attached to a picatinny rail of the gun 300, mounted to the slide of the gun 300, affixed to the grip of the gun 300, or the like.

The gun 300 includes a sensor 305-*a*, a sensor 305-*b*, a sensor 305-*c*, and a sensor 305-*d*, which illustrate example sensor locations on the gun 300. A sensor may include an IMU, an accelerometer, a gyroscope, a magnetometer, or the like. A sensor may be configured with one or more thresholds, and the sensor may transmit an interrupt based on the one or more thresholds being satisfied. As an example, the sensor 305-*a* may be configured with a first acceleration threshold for a first axis and a second acceleration threshold for a second axis, and the sensor 305-*a* may transmit an interrupt signal to a processor based on measuring acceleration that satisfies both the first acceleration threshold and the second acceleration threshold. For example, the sensor 305-*a* may transmit the interrupt signal in response to measuring acceleration in a first direction along a first axis that exceeds a first acceleration threshold while simultaneously measuring acceleration in a second direction along a second axis that exceeds a second acceleration threshold. The gun 300 may include a processor that is coupled with one or more of the sensors.

The sensor 305-*a* illustrates an example sensor location in the forward portion of the gun 300, the sensor 305-*b* illustrates an example sensor location that is proximate to the trigger guard, the sensor 305-*c* illustrates an example sensor location that is proximate to the magazine well, and the sensor 305-*d* illustrates an example sensor location in the lower grip portion of the gun 300.

Figure 4:
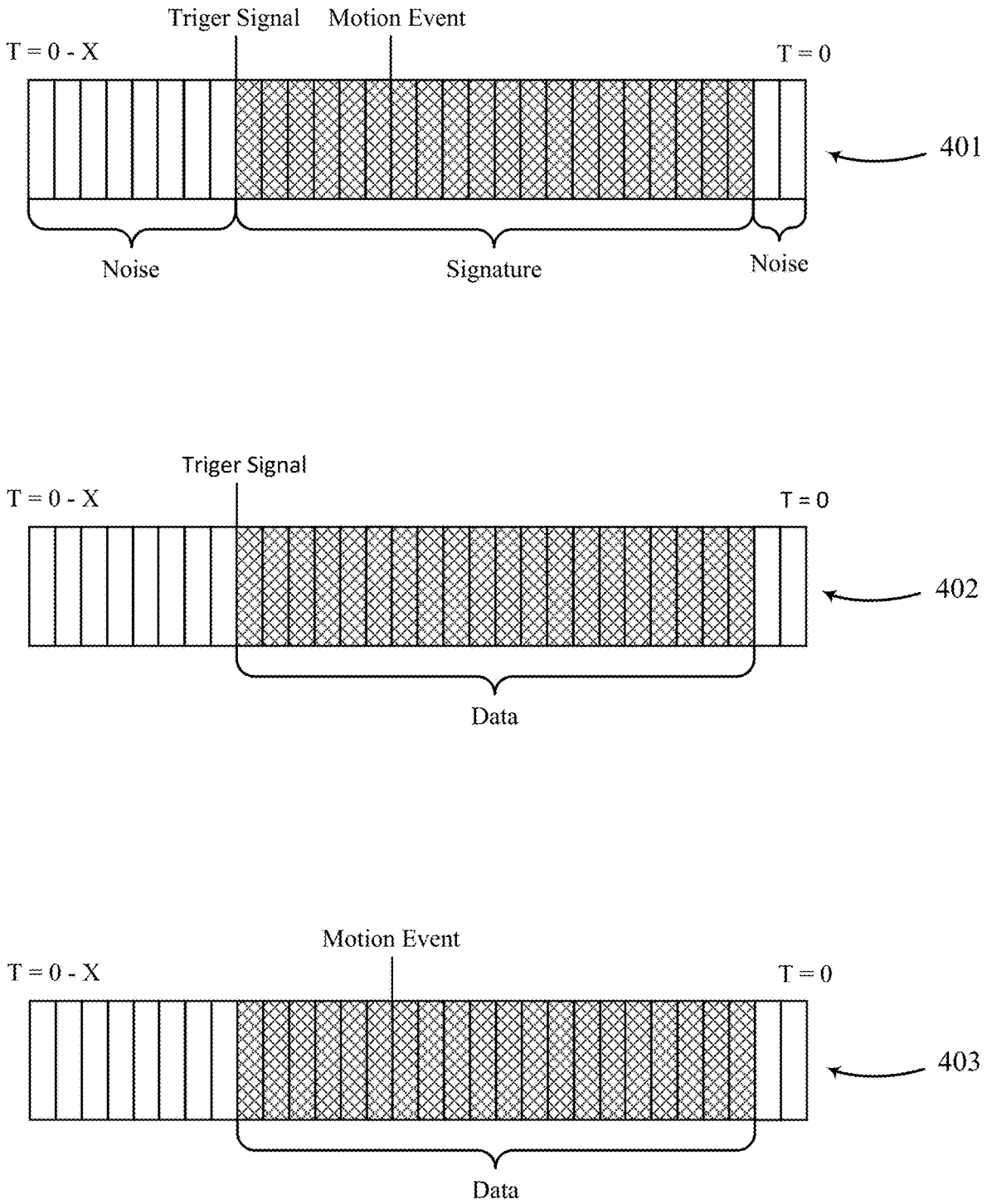
FIG. 4 illustrates examples of data buffers that support identifying gun events.

FIG. 4 illustrates an example of a data buffer 401, a data buffer 402, and a data buffer 403. As described herein, a data buffer can be used to identify gun events. A gun described herein may utilize techniques as described with reference to data buffer 401, data buffer 402, or data buffer 403. A data buffer may maintain a sliding window of information such that data is added to, and removed from, the data buffer in a first-in-first-out fashion. In some examples, a queue data structure may be used to maintain measurements of movement of a gun.

A gun may collect data measured by or more sensors in a data buffer (e.g., a sliding window). The data buffer may store data measured across a period of time, such as 50 milliseconds (ms), 500 ms, or anywhere in between. For example, a data buffer may store data measured within a time duration, such as data measured within the trailing "X" amount of time (e.g., 50 ms, 100 ms, 150 ms, 200 ms, 500 ms, etc.). In other words, the data buffer may include data measured between a first time (e.g., T=0, the newest data in the buffer) and a second time (e.g., T=0-X, the oldest data in the buffer), where "X" indicates the time duration for which the data buffer maintains the data. In some examples, a data buffer may store data in a first-in-first-out fashion based on the storage capacity of the data buffer. For example, the data buffer may push new data into the buffer and pop old data out of the buffer to create room for the new data.

The data buffer 401 illustrates a data signature representing gun movement that is response to discharging a projectile from the gun. The data signature may include measurements of movement that represent gun recoil, displacing the firing pin, ejecting a spent cartridge, feeding an unused cartridge, returning the slide to battery, etc. To generate the data signature, a user (e.g., a manufacturing or testing technician) may fire the gun and store measurements of gun movement, such as linear acceleration along one, two, or three axes and/or angular acceleration about one, two, or three axes. The data signature may include data captured in response to a firing event, such as an electrical signal (e.g., a trigger signal) or a mechanical event (e.g., a trigger break).

The data signature contained in the data buffer 401 includes measurements of movement that is responsive to a gun event, such as a nominal event (e.g., igniting projectile propellant, discharging a projectile, displacing a slide, returning to battery, etc.) or an anomalous event (e.g., a misfire, a malfunction, a cartridge jam, etc.). To generate the data signature, a user may record gun movement before, during, and after a projectile is fired from the gun. As such, the user may identify the data signature based on identifying a motion baseline before the firing event, the motion associated with the gun event, and the motion baseline after the gun event. As such, the user can store the identified data signature that is associated with the gun event while removing data that is not associated with the gun event (e.g., the noise). As such, a gun can compare current motion measurements to a stored data signature to determine whether a gun event has occurred.

The data signature may include measurements recorded across a time duration, such as 10 ms, 500 ms, or any time duration in between. The gun includes a data buffer capable of recording motion data for a time duration that is at least as large as the time duration of the data signature. For example, the size of the data buffer may be selected such that the buffer is capable of maintaining motion data for a time duration of at least "X", where "X" is greater than or equal to the time duration of the data signature. The data signature may include multiple motion thresholds, such as a linear acceleration threshold along a first axis and a rotational acceleration threshold about a second axis.

In some cases, the data signature may be generated based on a function of measurements. For example, the gun may be fired multiple times and the average or median of the measurements may be used to generate the data signature. The gun may be configured with one or more thresholds associated with the generated data signature, and the one or more thresholds may be used to determine whether a similarity condition is satisfied with respect to the data signature and data observed at the gun.

The gun may compare observed data (e.g., measured data, IMU data, etc.) to a data signature based on a firing event (e.g., a trigger signal) or a motion event (e.g., a saturated channel). For example, a sensor (e.g., an IMU) may transit an interrupt signal to a processor based on an acceleration measurement indicating a saturated channel (e.g., a threshold acceleration, a peak acceleration measurement for the sensor, a clipped signal for the channel, etc.), and the processor may determine whether one or more additional acceleration measurements satisfy threshold accelerations for the respective additional channels. If the one or more additional acceleration measurements satisfy the threshold accelerations for the respective channels, the gun may identify a nominal gun event, and if the one or more additional acceleration measurements do not satisfy the threshold accelerations for the respective channels, the gun may identify an anomalous gun event. The data buffer 402 includes data recorded based on a firing event, while the data buffer 403 includes data recorded based on a motion event.

In some examples, a gun may identify a gun event based on a motion event (e.g., measuring an acceleration value that is in a predetermined direction and greater than or equal to a predetermined magnitude) occurring within a time duration of a first event (e.g., a trigger signal, a trigger break, motion indicating a trigger break, etc.). For example, a gun may identify a nominal gun event in response to identifying a motion event within a time duration (e.g., 10 ms, 25 ms, 50 ms, 100 ms, etc.) of the trigger signal illustrated in data buffer 402. As another example, a gun may identify a nominal gun event in response to identifying a first event within a time duration (e.g., 10 ms, 25 ms, 50 ms, 100 ms, etc.) of the motion event illustrated in the data buffer 403.

The data buffer 402 illustrates data measured at a gun based on an electronic trigger signal (e.g., a firing event). A gun may maintain a buffer of data measured via one or more sensors (e.g., IMUs) and perform, based on a firing event such as a trigger signal, a procedure to determine whether the measured data matches a data signature. The gun may compare measured data to the data signature, and the gun may identify an anomalous event based on a time duration (e.g., 10 ms, 100 ms, or anywhere in between) elapsing before the measured data matches the data signature. In some cases, the measured data, or an indication thereof, may be stored in non-volatile memory coupled with the gun. The measured data or indication thereof may be stored based on a user configured data retention policy. For example, a user may configure the gun (e.g., via a user interface) to store gun event data for a period of time, the user may configure the gun to store encrypted gun event data, or the user may configure the gun to refrain from storing any gun event data.

The data buffer 403 illustrates data measured at a gun based on a motion event (e.g., a saturated channel, a measured acceleration value exceeding a threshold acceleration value, etc.). A gun may maintain a buffer of data measured via one or more sensors (e.g., IMUs), and perform, based on the motion event, a procedure to determine whether the measured data matches a stored data signature. For example, a sensor (e.g., an IMU) may be configured with a threshold, such as rotational movement threshold (e.g., degrees per second (dps) or revolutions per second), a linear movement threshold (e.g., meters per second (m/s)), or an acceleration threshold (e.g., g-force (g), meters per second squared ($m/s^2$), etc.), and the sensor may transmit an interrupt signal to a processor based on the threshold being satisfied.

In some cases, the measured data may be determined to match the data signature based on satisfying the threshold, while in some other cases, the gun may perform a procedure based on the threshold being satisfied, and the procedure may determine whether the measured data matches the data signature. The procedure for determining whether the measured data matches the data signature may include determining whether additional conditions are satisfied, such as an additional threshold for an additional axis, an orientation of the gun, the time difference between satisfying a first threshold and satisfying a second threshold being less than a time duration (e.g., 10 ms, 100 ms, or anywhere in between), or the time difference between satisfying a first threshold and the firing event being less than a time duration (e.g., 10 ms, 100 ms, or anywhere in between). The gun sensor may be configured with one or more thresholds. For example, the sensor may be configured with a linear motion threshold along a first axis and an angular motion threshold about a second axis.

The gun may identify a gun event based on a firing event (e.g., a trigger signal) or a motion event (e.g., a saturated channel, a first acceleration measurement satisfying a first threshold). The gun may identify the gun event as nominal based on one or more conditions being satisfied (e.g., a second acceleration measurement satisfying a second threshold, a time different between the firing event and an additional condition, a time different between the motion event and an additional condition, an orientation of the gun, etc.). For example, the gun may identify a nominal gun event based on the time difference between an event (e.g., a motion event or a firing event) and an additional condition (measuring acceleration that satisfies an acceleration threshold of a data signature) satisfying a time threshold (e.g., 10 ms, 100 ms, or anywhere in between). The gun may identify the gun event as anomalous based on a time duration elapsing or based on one or more conditions not being satisfied. For example, the gun may identify an anomalous event based on identifying an event (e.g., a motion event or a firing event) and a time duration (e.g., 10 ms, 100 ms, or anywhere in between) elapsing.

Figure 5:
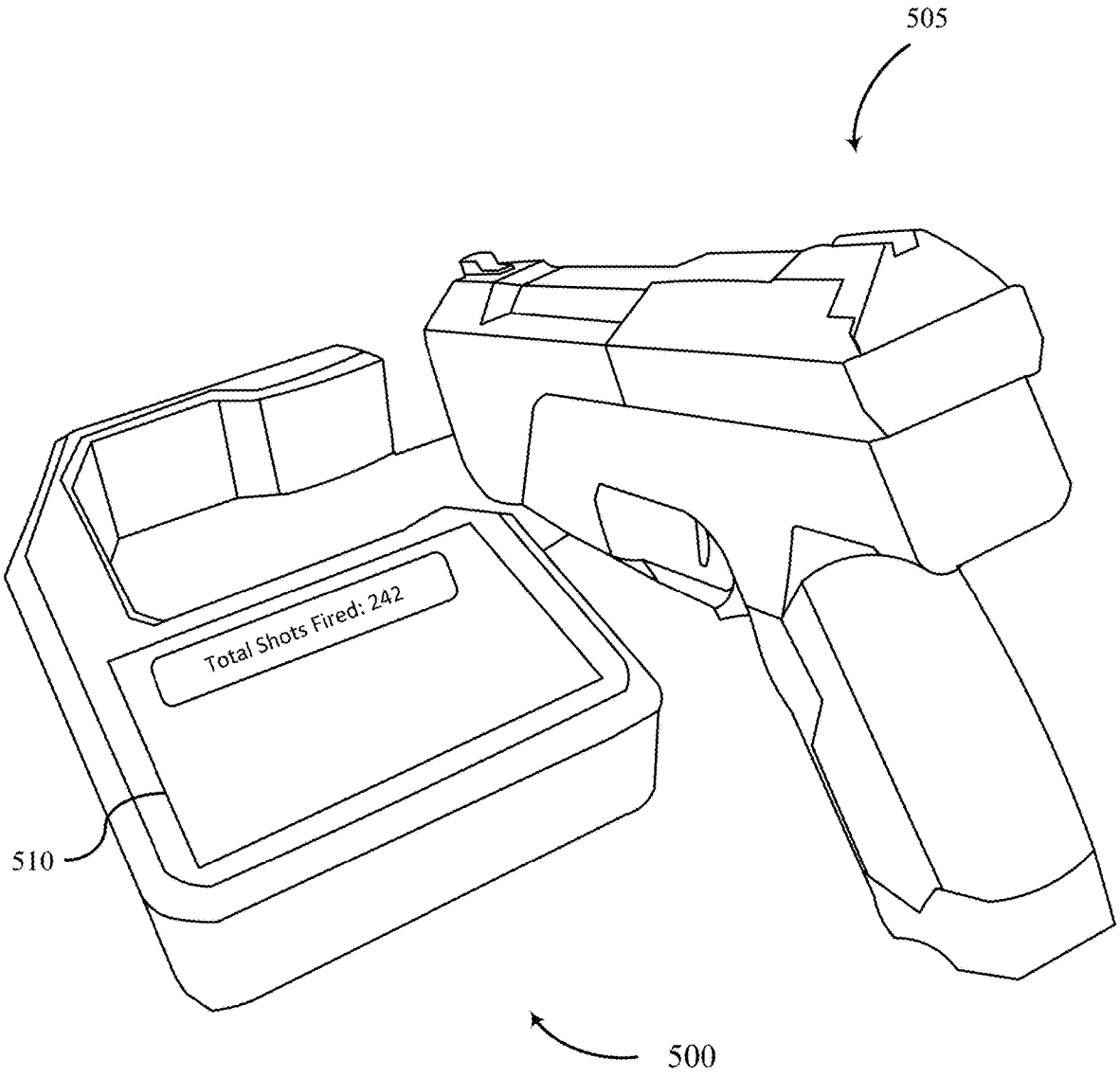
FIG. 5 illustrates an example of a docking station that can be connected to a gun.

FIG. 5 illustrates an example of a docking station 500 that can be connected to a gun 505. The gun 505 may be connected to the docking station 500 via a wired connection or a wireless connection.

In some examples, the gun 505 may be electronically coupled with the docking station 500 via a wired connection (e.g., a universal serial bus (USB), a USB-C, etc.). The user interface 510 of the docking station 500 may be used to configure the gun (e.g., whether to save measured data, whether to save indications of gun events, etc.) or display gun event information, such as the number of shots fired. The docking station 500 may indicate whether the gun 505 is loaded and/or how many rounds are present in the gun 505. A user may configure the gun 505 at the docking station 500 based on an authentication procedure. For example, the docking station 500 and/or the gun 505 may verify authentication data (e.g., biometric data, a password, a personal identification number (PIN), etc.), and the user may use the user interface 510 to configure the gun 505 based on the authentication data. The user may be able to configure the gun 505 based on the authentication procedure verifying that the user is an authorized operator of the gun 505, and the user may be unable to configure the gun 505 based on the authentication procedure determining that the user is not an authorized operator of the gun 505.

Figure 6:
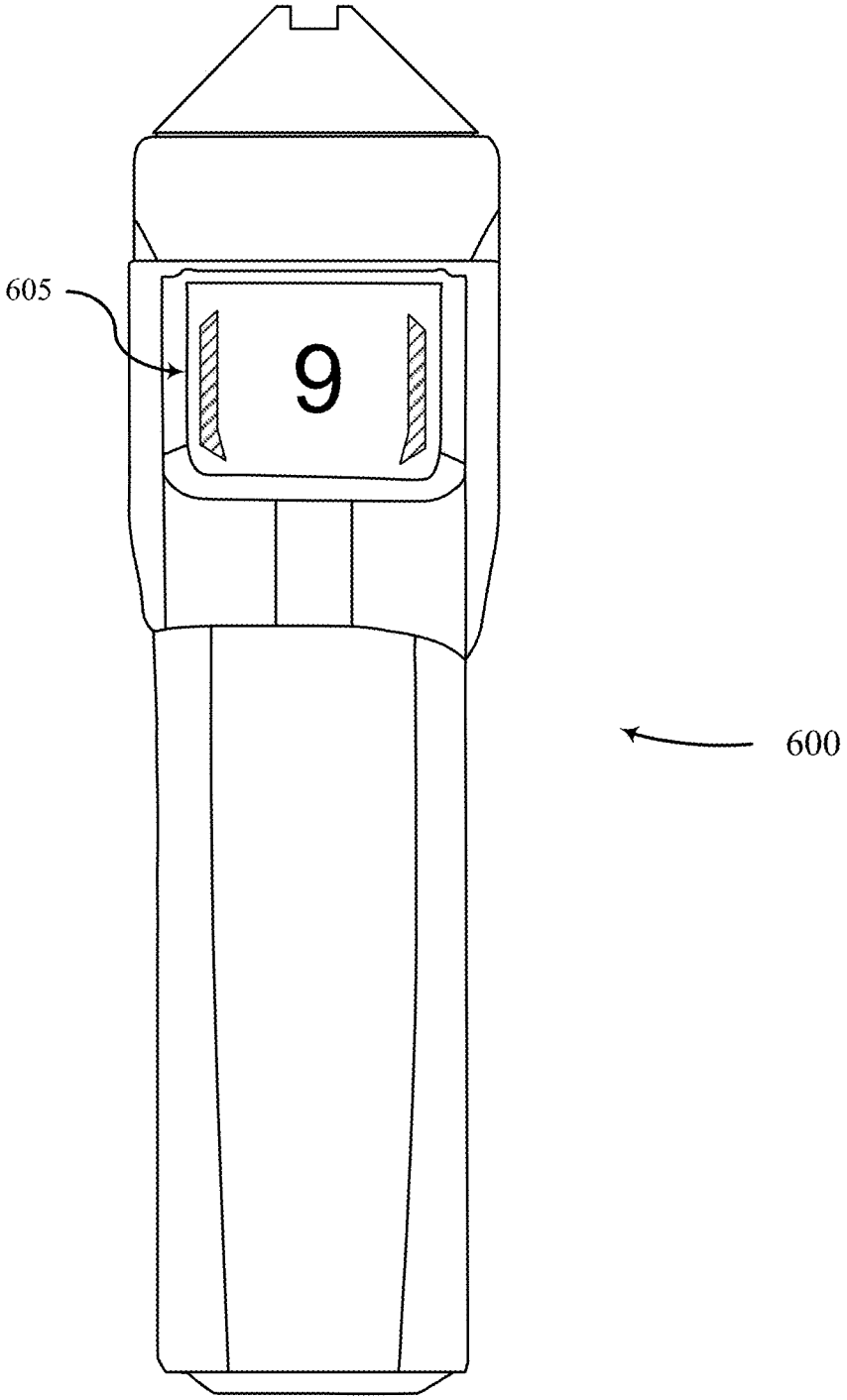
FIG. 6 illustrates an example of a gun displaying information related to gun events.

FIG. 6 illustrates an example of a gun 600 displaying information related to gun events. For example, the user interface 605 may be used to display gun event information and/or configure the gun 600. The user interface 605 may receive information (e.g., user-input provided by a user), display information (e.g., visual information, such as the number of rounds present in the gun), or both. The user interface 605 may display the number of cartridges in the gun, and the gun 600 may determine the number of cartridges in the gun based on gun events.

In some examples, a user may provide user-input to the user interface 605 to indicate the number of rounds present in the gun 600 and the user interface 605 may display a numerical representation of the number of rounds present in the gun 600. The gun 600 may identify a gun event, such as the nominal discharge of a round, and the user interface 605 may be updated in response to the gun event such that the user interface 605 displays the true number of rounds present in the gun is accurate. In other words, a user may provide user-input indicating the number of rounds present in the gun 600, the gun 600 may decrement a running count each time a round is fired, and the user interface 605 may be updated to indicate the number of rounds remaining in the gun 600. In some examples, the gun 600 may maintain a count of the total number of rounds that have been fired. The gun 600 may refrain from storing the count of the total number of rounds that have been fired by default, and a user may opt-in to storing the count of the total number of rounds that have been fired by configuring the gun 600 via a user interface. The user interface may be coupled with the gun, a docking station, or a mobile device.

The user interface 605 shown in FIG. 6 is located on the rearward portion of the gun 600, above the grip and below the slide. It should be understood that a user interface may be positioned in additional or alternative location on a gun. For example, a user interface may be located on the grip, on the frame of the gun, proximate to a trigger guard, or the like.

Figure 7:
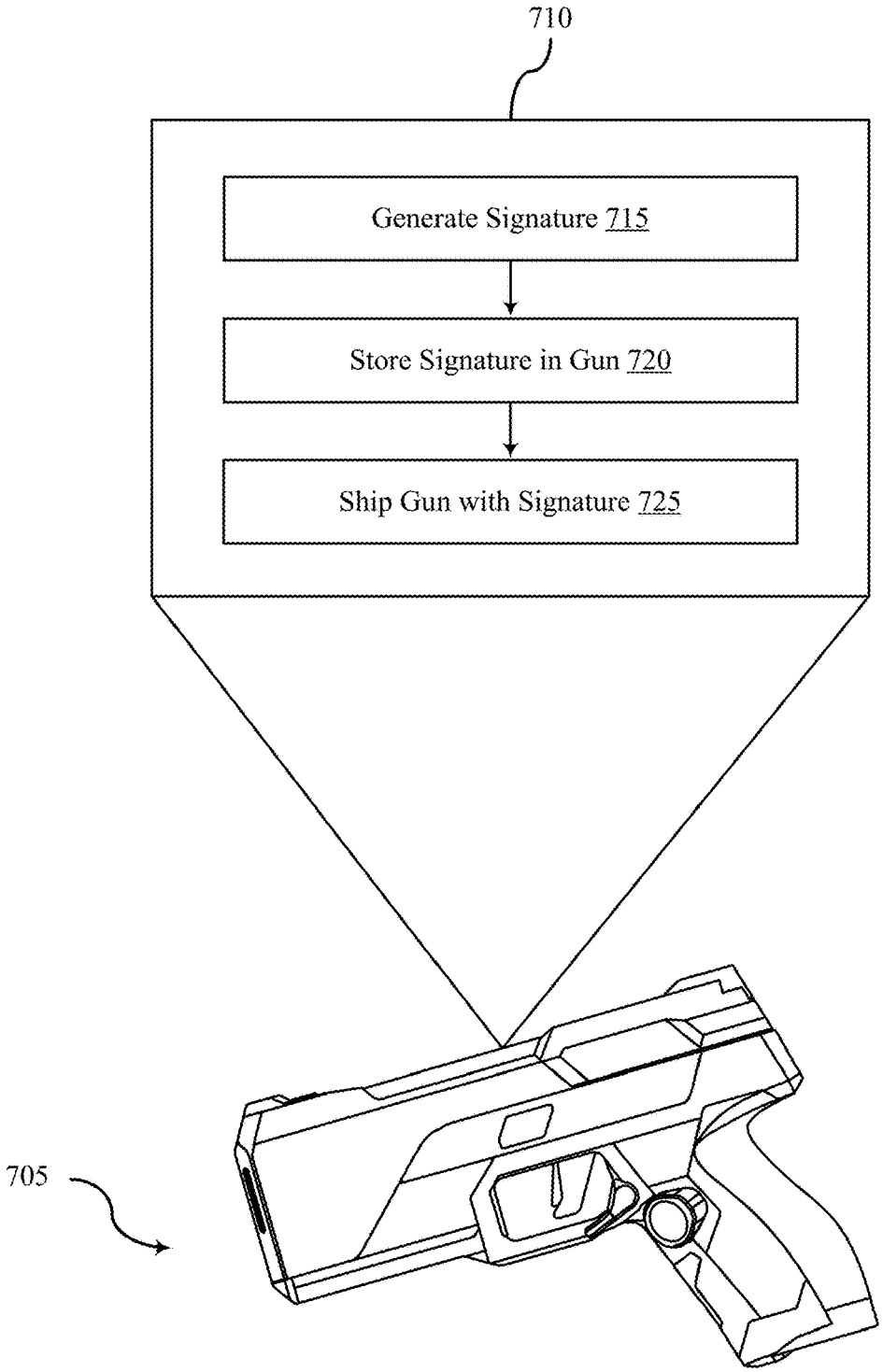
FIG. 7 illustrates an example of a configuration procedure that supports configuring a gun with a data signature representing a gun event.

FIG. 7 illustrates an example of a configuration procedure 710 that supports configuring a gun 705 with a data signature representing a gun event.

The gun 705 may be configured with a data signature based on the configuration procedure 710. A data signature is generated at step 715. The data signature may be generated based on firing a projectile from a gun and/or modeling gun movement that is responsive to firing the gun. In some cases, the data signature may be generated based on firing a gun multiple times, measuring the gun motion, and applying a function (e.g., mean, median, etc.) to the measurements for one or more axes (e.g., channels).

The data signature and/or gun may be configured with a tolerance. In some examples, one or more measurements of movement may be discounted such that satisfying the discounted measurement corresponds to satisfying the similarity condition between measured data and the data signature. For example, the measured angular velocity may correspond to a value (e.g., 1500 dps), which may be discounted by a percentage (e.g., 10%), such that satisfying the discounted value (e.g., 1350) corresponds to satisfying the measured angular velocity. Satisfying the angular velocity may correspond to satisfying the similarity condition between the measured data and the data signature, or satisfying the angular velocity may correspond to satisfying a first portion of the similarity condition between the measured data and the data signature, where satisfying the similarity condition corresponds to satisfying the first portion and a second portion (e.g., an angular velocity about another axis, an acceleration along an axis, an orientation of the gun, etc.).

At step 720, the data signature may be stored in the gun 705. The data signature may be stored in memory, and the data signature may include one or more motion thresholds. In some examples the data signature may be stored in the gun that was used to generate the data signature, while in other examples the data signature may be deployed to multiple guns that possess similar characteristics (e.g., multiple guns of the same weight, multiple guns of the same size, multiple guns that are the same model, etc.).

At step 725, the gun 705 may be shipped to a customer (or a federal firearms license (FFL) possessing dealer) with the data signature. As such, the gun 705 may be configured with the data signature upon delivery. In some examples, the customer may indicate a configuration preference, and the gun 705 may include the data signature based on the indicated preference. For example, a first customer may indicate a preference (via website, telephone, or mobile application) for the gun to include the data signature, and the gun will be shipped with the data signature. A second customer may indicate a preference (via website, telephone, or mobile application) for the gun to not include the data signature, and the gun will be shipped without the data signature. As another example, a customer may provide customer information such as a level of experience, a body weight, a body size, a hand size, or the like, and the data signature may be generated based on the customer information.

Figure 8:
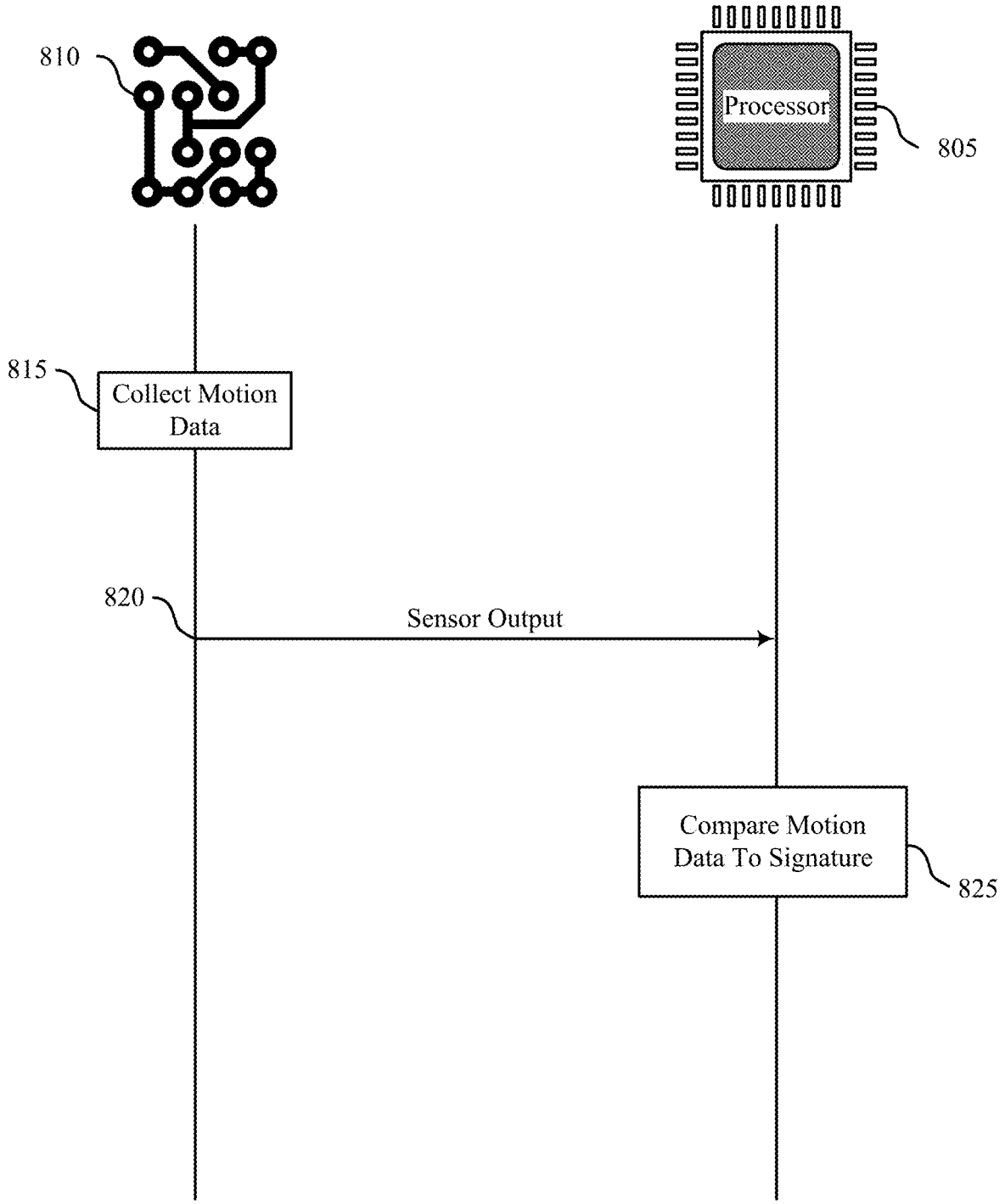
FIG. 8 illustrates an example of a process flow for identifying a gun event.

FIG. 8 illustrates an example of a process flow 800 for identifying a gun event. The process flow 800 includes a processor 805 and a sensor 810. The processor 805 may be an aspect of the sensor 810, or the processor 805 may be a distinct component that is electronically coupled with the sensor 810. The processor 805 may include an analog electrically circuit and/or a digital electrically circuit. The operations of process flow 800 may be implemented by a weapon, a gun, a gun attachment, or components thereof. Alternative examples of the following may be implemented where some steps are performed in a different order than described or are not performed at all. The steps may include additional features not mentioned below, and further steps may be added.

At step 815, the sensor 810 may measure or collect motion data, and the motion data may be collected for one axis or multiple axes. The sensor 810 may measure linear acceleration along a first axis and angular acceleration about a second axis. As an example, the sensor 810 may generate a data structure that includes multiple columns (or rows), where each column corresponds to an axis and each element of each column represents a measurement of acceleration for the respective axis at a point in time. As another example, the sensor 810 may generate multiple data structures, where each data structure corresponds to a type of measurement (e.g., linear acceleration, angular acceleration, linear velocity, angular velocity, orientation, force, etc.).

At step 820, the sensor 810 may transmit output data to the processor 805. The output data may include acceleration values measured by the sensor 810. The output data may include acceleration values for one axis, two axes, or three axes. The output data may include raw data or filtered data.

At step 825, the processor 805 may compare the motion data collected by the sensor 810 to a data signature. The data signature may include motion data that is indicative of a gun event, such as a nominal discharge or an anomalous discharge. In other words, the gun may include a first data signature corresponding to movement of the gun during a nominal gun event and as well as a second data signature corresponding movement of the gun during an anomalous gun event. The processor 805 may identify a type of gun event based on the data signature that matches the motion data collected by the sensor 810.

The motion data collected by the sensor 810 may match a data signature when a similarity condition is satisfied. As an example, a similarity condition may be satisfied based on a measured acceleration value exceeding a threshold acceleration value of the data signature. As another example, the similarity condition may be satisfied based on a measured linear acceleration value along a first axis exceeding a threshold linear acceleration value for the first axis and a measured angular acceleration value along a second axis exceeding a threshold angular acceleration value for the second axis. As another example, the similarity condition may be satisfied based on a measured acceleration value being within a predetermined range (e.g., the measured acceleration value is within 5% of the threshold acceleration value, the measured acceleration value is within 20% of the threshold acceleration value, etc.) of a threshold acceleration value. As yet another example, the similarity condition may be satisfied based on a measured acceleration value exceeding a threshold acceleration value within a time duration of a firing event (e.g., a trigger break, a capacitor discharge, a collision between a firing pin and a primer cap, motion of the gun indicating a trigger break, etc.). In other words, the similarity condition may be satisfied based on the gun accelerating a threshold amount within a predetermined amount of time of a firing event. In some cases, a firing event may be referred to as a "first event."

Figure 9:
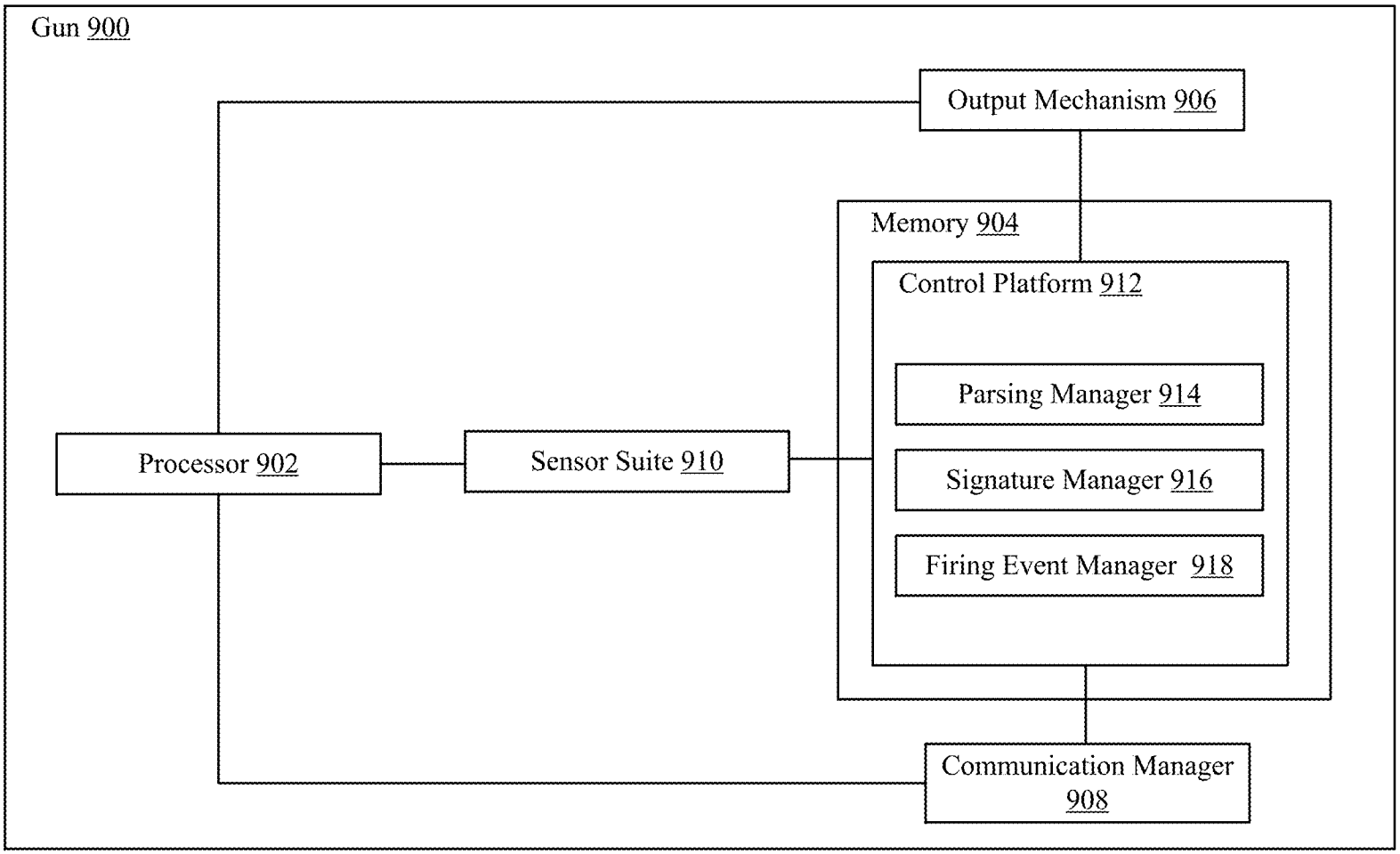
FIG. 9 illustrates an example of a gun that supports identifying events.

FIG. 9 illustrates an example of a gun 900 able to implement a control platform 912 designed to produce outputs that are helpful in identifying events at the gun 900. As further discussed below, the control platform 912 (also referred to as a "management platform" or an "event manager") may be designed to identify nominal events, identify anomalous events, or perform configuration procedures.

In some embodiments, the control platform 912 is embodied as a computer program that is executed by the gun 900. In other embodiments, the control platform 912 is embodied as an electrical circuit that performs logical operations of the gun 900. In yet other embodiments, the control platform 912 is embodied as a computer program that is executed by a computing device to which the gun 900 is communicatively connected. In such embodiments, the gun 900 may transmit relevant information to the computing device for processing as further discussed below. Those skilled in the art will recognize that aspects of the computer program could also be distributed amongst the gun 900 and computing device.

The gun 900 can include a processor 902, memory 904, output mechanism 906, and communication manager 908. The processor 902 can have generic characteristics similar to general-purpose processors, or the processor 902 may be an application-specific integrated circuit (ASIC) that provides control functions to the gun 900. The processor 902 may be an aspect of a sensor that is capable of measuring movement, or the processor 902 may be electronically coupled with a sensor that is capable of measuring movement. As shown in FIG. 9, the processor 902 can be coupled with all components of the gun 900, either directly or indirectly, for communication purposes.

The memory 904 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 902, the memory 904 can also store data generated by the processor 902 (e.g., when executing the managers of the control platform 912). Note that the memory 904 is merely an abstract representation of a storage environment. The memory 904 could be comprised of actual memory chips or managers.

The output mechanism 906 can be any component that is capable of conveying information to a user of the gun 900. For example, the output mechanism 906 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 900. Thus, the display may indicate whether the gun 900 is presently in a locked state, unlocked state, etc. As another example, the output mechanism 906 may be a loudspeaker (or simply "speaker") that is able to audibly convey information to the user.

The communication manager 908 may be responsible for managing communications between the components of the gun 900. Additionally or alternatively, the communication manager 908 may be responsible for managing communications with computing devices that are external to the gun 900. Examples of computing devices include mobile phones, tablet computers, wearable electronic devices (e.g., fitness trackers), and network-accessible server systems comprised of computer servers. Accordingly, the communication manager 908 may be wireless communication circuitry that is able to establish communication channels with computing devices. Examples of wireless communication circuitry include integrated circuits (also referred to as "chips") configured for Bluetooth, Wi-Fi®, NFC, and the like.

Sensors are normally implemented in the gun 900. Collectively, these sensors may be referred to as the "sensor suite" 910 of the gun 900. For example, the gun 900 may include a motion sensor whose output is indicative of motion of the gun 900 as a whole. Examples of motion sensors include multi-axis accelerometers and gyroscopes. As another example, the gun 900 may include a proximity sensor whose output is indicative of proximity of the gun 900 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. As another example, the gun 900 may include a fingerprint sensor or camera that generates images which can be used for, for example, biometric authentication. As shown in FIG. 9, outputs produced by the sensor suite 910 may be provided to the control platform 912 for examination or analysis.

For convenience, the control platform 912 may be referred to as a computer program that resides in the memory 904. However, the control platform 912 could be comprised of software, firmware, or hardware components that are implemented in, or accessible to, the gun 900. In accordance with embodiments described herein, the control platform 912 may include a parsing manager 914, a signature manager 916, and a firing event manager 918. As an illustrative example, the parsing manager 914 may process data generated by, and obtained from, a sensor (e.g., an IMU, an accelerometer, a gyroscope, etc.), the signature manager 916 may retrieve data signatures from memory, and the firing event manager 918 may process data generated by a trigger sensor, a motion sensor, a DSP, a controller, or the like. Because the data obtained by these managers may have different formats, structures, and content, the instructions executed by these managers can (and often will) be different. For example, the instructions executed by the parsing manager 914 to process data generated by an IMU may be different than the instructions generated by the signature manager 916 to retrieve a data signature from memory.

Figure 10:
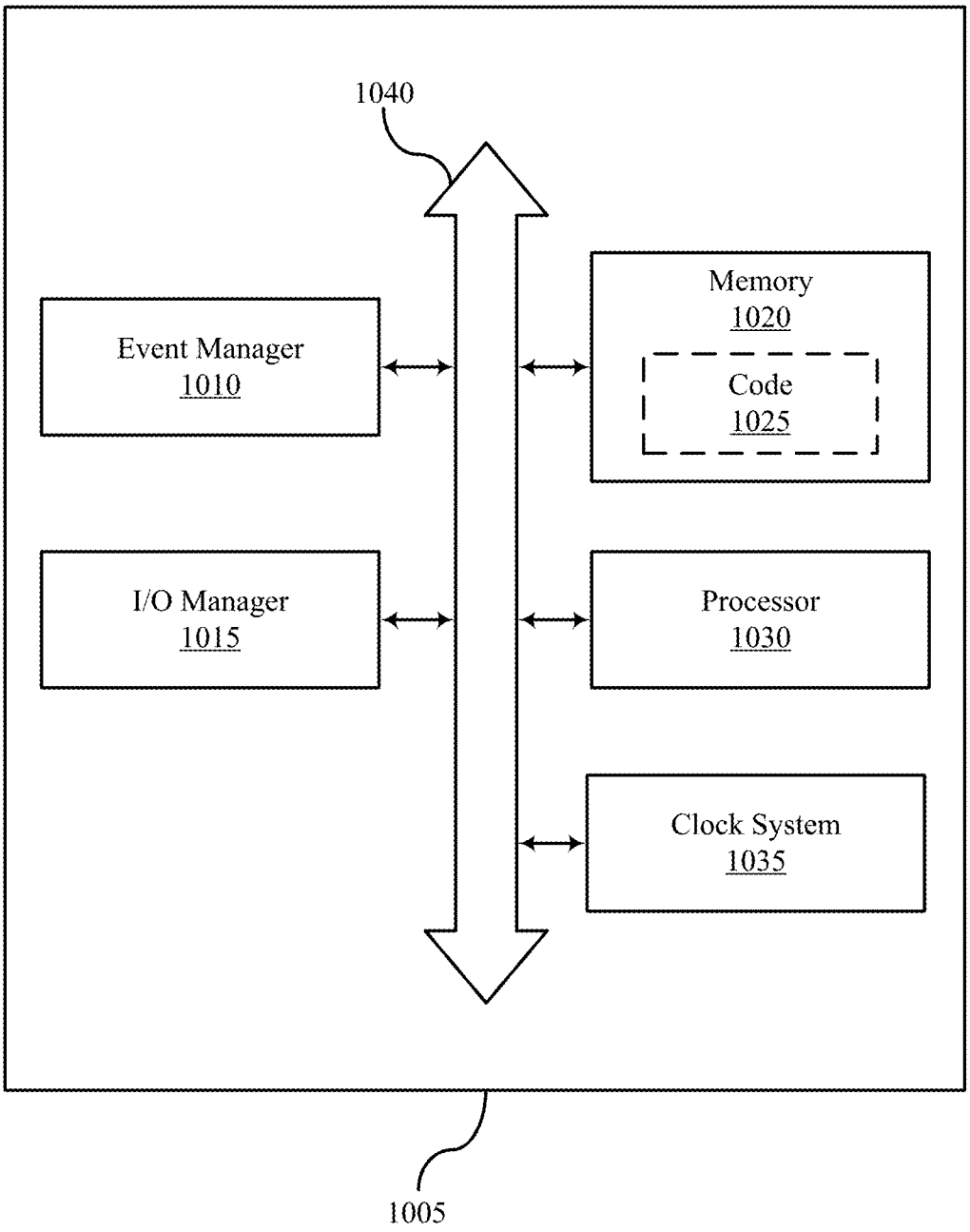
FIG. 10 illustrates an example of a system that supports identifying events.

FIG. 10 illustrates an example of a system 1000 that supports identifying gun events. The device 1005 may be operable to implement the techniques, technology, or systems disclosed herein. The device 1005 may include components such as an event manager 1010, an input/output (I/O) manager 1015, memory 1020, code 1025, a processor 1030, a clock system 1035, and a bus 1040. The components of the device 1005 may communicate via one or more buses 1040. The device 1005 may be an example of, or include components of, a gun or an apparatus that is capable of being affixed to a gun.

The event manager 1010 may transmit an electrical signal to an actuator, so as to cause displacement of the actuator that results in a projectile being propelled through a barrel of the device 1005, obtain data that is representative of measurements of motion of the device 1005, as measured by a sensor in real time along multiple axes, parse the data to discover one or more measurements that are indicative of an event that results in a predictable amount of motion or direction of motion, confirm that the one or more measurements are generated by the sensor within a threshold duration of the electrical signal being transmitted to the actuator, and store an indication of the event in memory.

The event manager 1010 may identify a firing event based on first motion of the device 1005 matching a first data signature representing motion of the device 1005 during a trigger break, identify a recoil event based on second motion of the device 1005 matching a second data signature representing motion of the device 1005 during a gunshot, determine that the difference in time between the recoil event and the firing event is less than a predetermined time threshold, and identify a gun event corresponding to a nominal discharge of a projectile based on the difference in time between the recoil event and the firing event being less than the predetermined time threshold. The event manager 1010 may reset a charging circuit of the device 1005 in response to the gun event. The predetermined time threshold may be 5 ms, 250 ms, or anywhere in between.

The event manager 1010 may measure motion of the device 1005 along multiple axes, identify a gun event based on the measured motion of the device 1005 satisfying a motion condition, where the motion condition comprises an acceleration threshold, and transmit, based on the measured motion of the device 1005 satisfying the motion condition, an electrical signal indicating the gun event. The electrical signal may cause a charging circuit to be reset, a capacitor bank to be charged, a shot count to be incremented, or a round count to be decremented. The shot count may indicate the number of times the device 1005 has been fired, and the round count may indicate the number of rounds present in the device 1005.

The I/O manager 1015 may manage input and output signals for the device 1005. The I/O manager 1015 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 1020 may include or store code (e.g., software) 1025. The memory 1020 may include volatile memory, such as random-access memory (RAM) and/or non-volatile memory, such as read-only memory (ROM). The code 1025 may be computer-readable and computer-executable, and when executed, the code 1025 may cause the processor 1030 to perform various operations or functions described here.

The processor 1030 may be an example or component of a central processing unit (CPU), an application specific integrated circuit (ASIC), or a field programmable gate array (FPGA). In some embodiments, the processor 1030 may utilize an operating system or software such as Microsoft Windows®, iOS®, Android®, Linux®, Unix®, or the like. The clock system 1035 control a timer for use by the disclosed embodiments.

The event manager 1010, or its sub-components, may be implemented in hardware, software (e.g., software or firmware) executed by a processor, or a combination thereof. The event manager 1010, or its sub-components, may be physically located in various positions. For example, in some cases, the event manager 1010, or its sub-components may be distributed such that portions of functions are implemented at different physical locations by one or more physical components.

Figure 11:
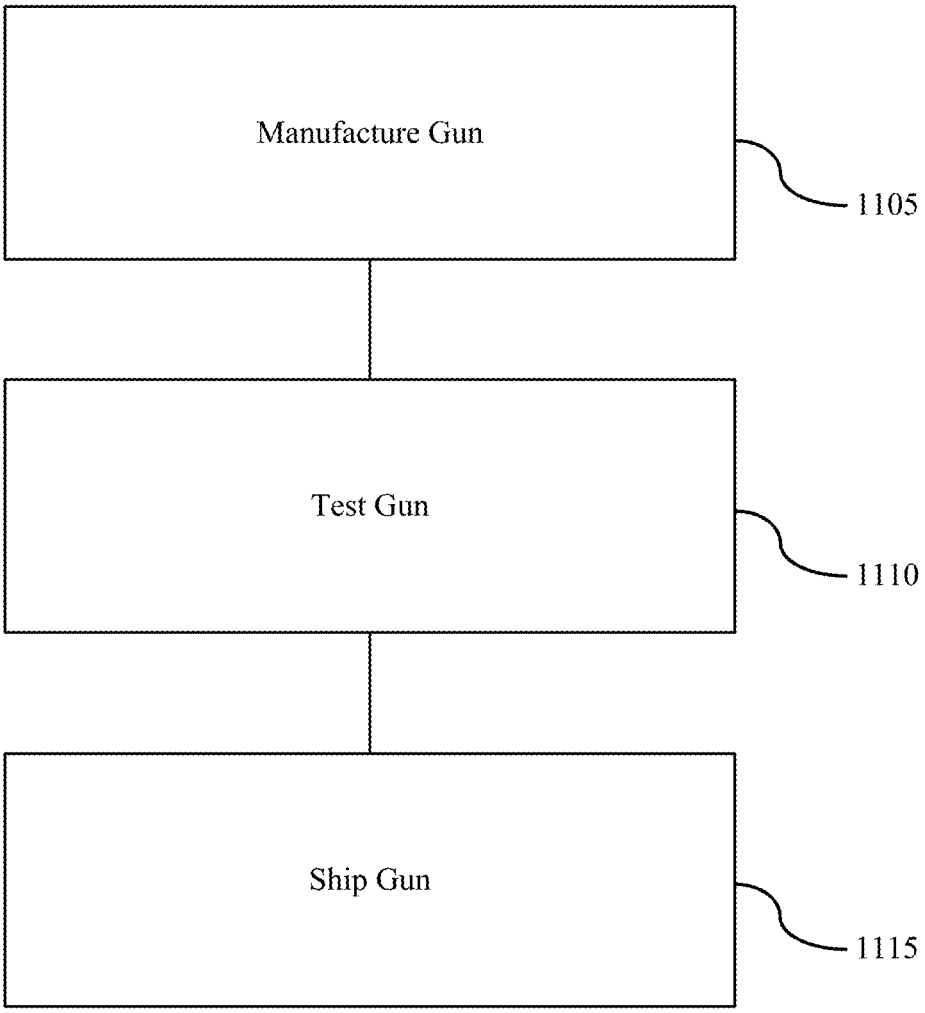
FIG. 11 illustrates an example of a flowchart showing a method of manufacturing a device that is capable of identifying gun events.

FIG. 11 illustrates an example of a flowchart 1100 that supports identifying gun events. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a gun manufacturer (or simply "manufacturer") may manufacture a gun that is able to implement aspects of the present disclosure (step 1105). For example, the manufacturer may machine, cut, shape, or otherwise make parts to be included in the gun. Thus, the manufacturer may also design those parts before machining occurs, or the manufacturer may verify designs produced by another entity before machining occurs. Additionally or alternatively, the manufacturer may obtain parts that are manufactured by one or more other entities. Thus, the manufacturer may manufacture the gun from components produced entirely by the manufacturer, components produced by other entities, or a combination thereof. Often, the manufacturer will obtain some parts and make other parts that are assembled together to form the gun (or a component of the gun).

In some embodiments, the manufacturer also generates identifying information related to the gun. For example, the manufacturer may etch (e.g., mechanically or chemically), engrave, or otherwise append identifying information onto the gun itself. As another example, the manufacturer may encode at least some identifying information into a data structure that is associated with the gun. For instance, the manufacturer may etch a serial number onto the gun, and the manufacturer may also populate the serial number (and other identifying information) into a data structure for recording or tracking purposes. Examples of identifying information include the make of the gun, the model of the gun, the serial number, the type of projectiles used by the gun, the caliber of those projectiles, the type of firearm, the barrel length, and the like. In some cases, the manufacturer may record a limited amount of identifying information (e.g., only the make, model, and serial number), while in other cases the manufacturer may record a larger amount of identifying information.

The manufacturer may then test the gun (step 1110). In some embodiments, the manufacturer tests all of the guns that are manufactured. In other embodiments, the manufacturer tests a subset of the guns that are manufactured. For example, the manufacturer may randomly or semi-randomly select guns for testing, or the manufacturer may select guns for testing in accordance with a predefined pattern (e.g., one test per 5 guns, 10 guns, or 100 guns). Moreover, the manufacturer may test the gun in its entirety, or the manufacturer may test a subset of its components. For example, the manufacturer may test the component(s) that it manufactures. As another example, the manufacturer may test newly designed components or randomly selected components. Thus, the manufacturer could test select component(s) of the gun, or the manufacturer could test the gun as a whole. For example, the manufacturer may test the barrel to verify that it meets a precision threshold and the cartridge feed system to verify that it meets a reliability threshold. As another example, the manufacturer may test a group of guns (e.g., all guns manufactured during an interval of time, guns selected at random over an interval of time, etc.) to ensure that those guns fire at a sufficiently high pressure (e.g., 70,000 pounds per square inch (PSI)) to verify that a safety threshold is met.

The manufacturer may test a system for identifying events by exposing the gun to known events and verifying that the system identifies the events as expected. For example, the manufacturer may fire a gun that includes, or is attached to, a system that is capable of identifying events, and the manufacturer may verify that the system has identified a nominal event. As another example, the manufacturer may facilitate the occurrence of a misfire, and the manufacturer may verify that the system has identified an anomalous event.

Thereafter, the manufacturer may ship the gun to a dealer (step 1115). In the event that the gun is a firearm, the manufacturer may ship the gun to a Federal Firearms Licensed (FFL) dealer. For example, a purchaser (also referred to as a "customer") may purchase the apparatus through a digital channel or non-digital channel. Examples of digital channels include web browsers, mobile applications, and desktop applications, while examples of non-digital channels include ordering via the telephone and ordering via a physical storefront. In such a scenario, the gun may be shipped to the FFL dealer so that the purchaser can obtain the gun from the FFL dealer. The FFL dealer may be directly or indirectly associated with the manufacturer of the gun. For example, the FFL dealer may be a representative of the manufacturer, or the FFL dealer may sell and distribute guns on behalf of the manufacturer (and possibly other manufacturers).

Note that while the sequences of the steps performed in the processes described herein are exemplary, the steps can be performed in various sequences and combinations. For example, steps could be added to, or removed from, these processes. Similarly, steps could be replaced or reordered. As an example, the manufacturer may iteratively test components while manufacturing the gun, and therefore perform multiple iterations of steps 1105 and 1110 either sequentially or simultaneously (e.g., one component may be tested while another component is added to the gun). Thus, the descriptions of these processes are intended to be open ended.

Figure 12:
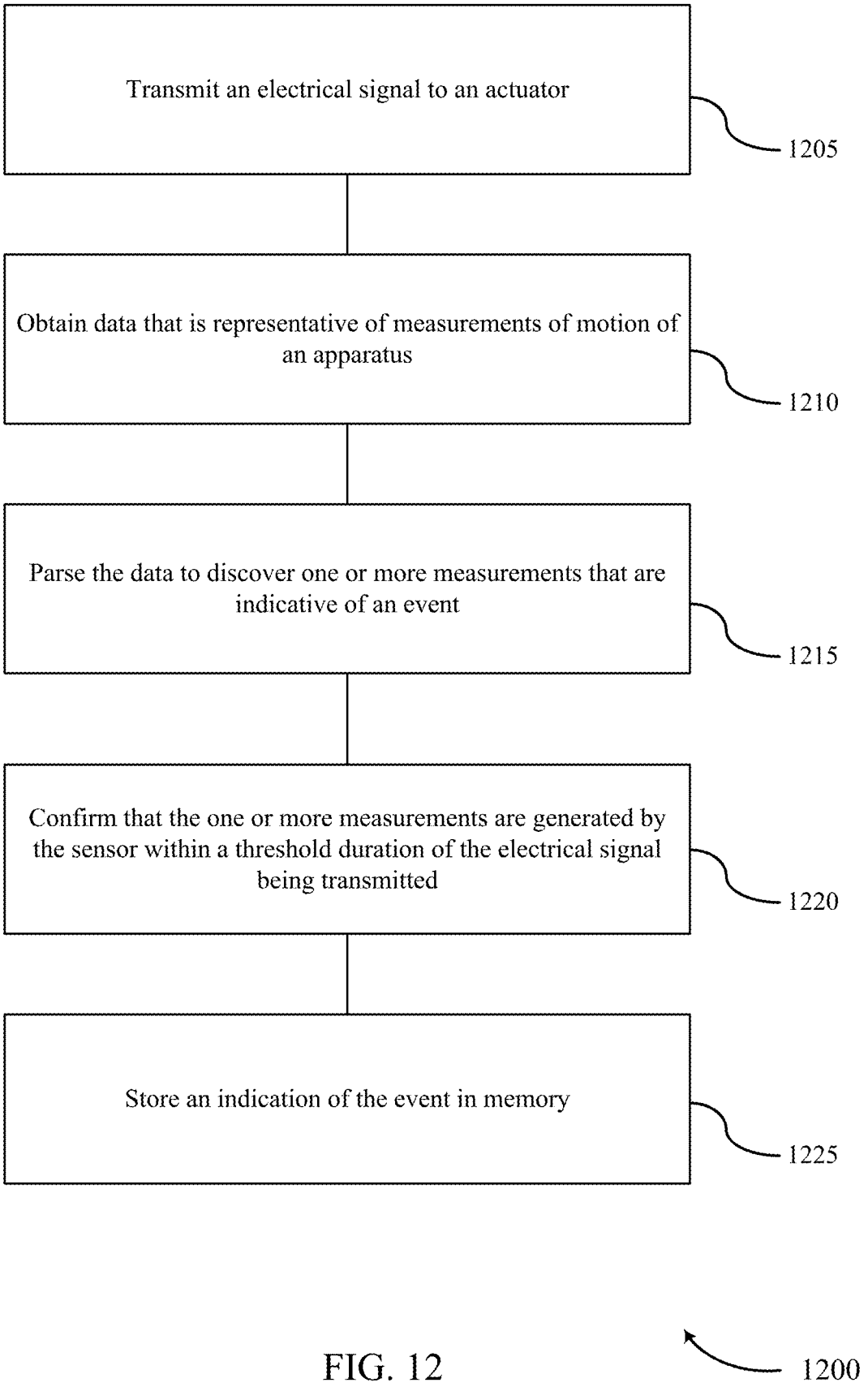
FIG. 12 illustrates an example of a flowchart showing a method of identifying a gun event.

FIG. 12 shows a flowchart illustrating a method 1200 of identifying a gun event. The operations of the method 1200 may be implemented by a gun or a device that is capable of being affixed to a gun. For example, the operations of the method 1200 may be performed by an apparatus, such as a gun or a device that is capable of being affixed to a gun. In some examples, a processor (or a controller or an event manager) may execute a set of instructions to control the functional elements of the apparatus to perform the described functions. Additionally or alternatively, the apparatus may perform aspects of the described functions using special-purpose hardware.

At step 1205, an apparatus may transmit an electrical signal to an actuator, so as to cause displacement of the actuator that results in a projectile being propelled through a barrel of a gun. For example, the actuator may be configured to mechanical firing mechanism (e.g., a sear, a striker, a hammer, etc.), and the electrical signal may cause displacement of the actuator such that the mechanical firing mechanism is released.

At step 1210, the apparatus may obtain data that is representative of measurements of motion of the apparatus, as measured by a sensor in real time along multiple axes. The data may include linear acceleration data for one or more axes. The data may additionally or alternatively include angular acceleration data for one or more axes.

At step 1215, the apparatus may parse the data to discover one or more measurements that are indicative of an event that results in a predictable amount of motion or direction of motion. For example, the apparatus may parse the data to discover a measurement of linear acceleration that is indicative of a gunshot that results in a predictable amount of recoil.

At step 1220, the apparatus may confirm that the one or more measurements are generated by the sensor within a threshold duration of the electrical signal being transmitted to the actuator. The apparatus may confirm that the measurement of linear acceleration indicating recoil responsive to a gunshot has occurred within a threshold duration of an electrical signal. The electrical signal may indicate a trigger break, or the electrical signal may cause the apparatus to fire a projectile.

At step 1225, the apparatus may store an indication of the event in memory. For example, the apparatus may store an indication of a nominal gun event. The apparatus may additionally or alternatively update a shot count and/or a round count.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Figure 13:
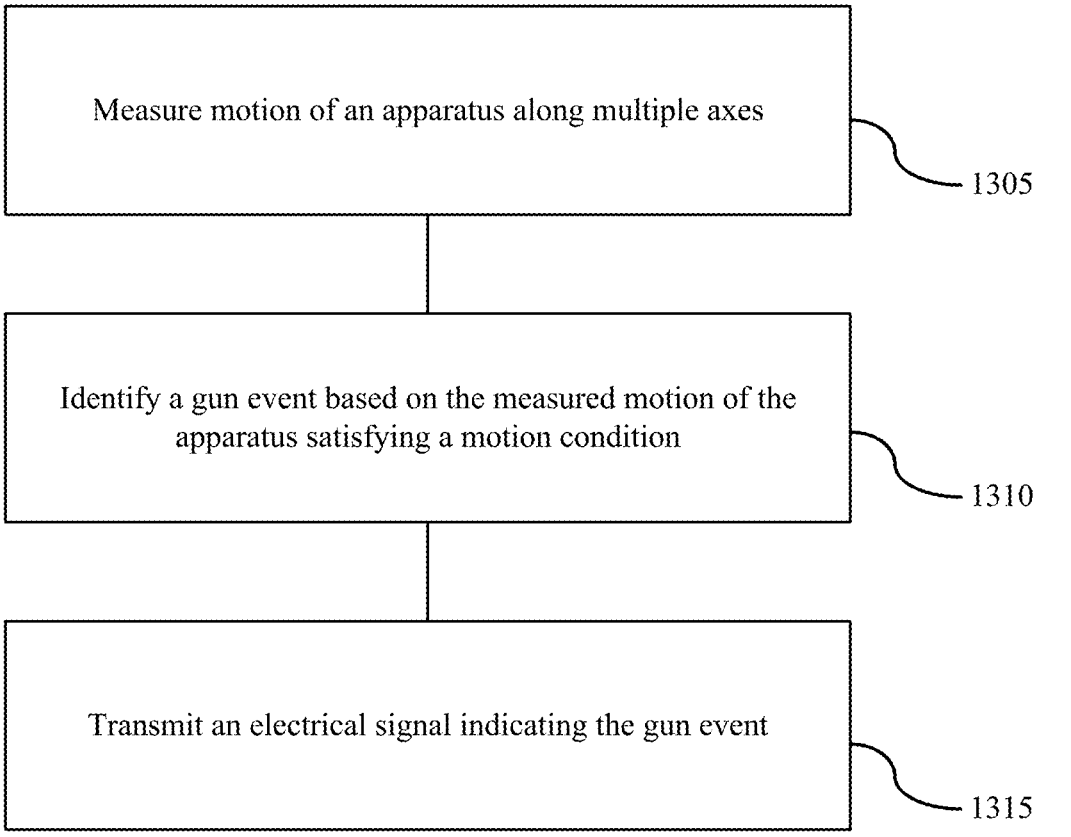
FIG. 13 illustrates an example of a flowchart showing a method of identifying a gun event.

FIG. 13 shows a flowchart illustrating a method 1300 of identifying a gun event. The operations of the method 1300 may be implemented by a gun or a device that is capable of being affixed to a gun. For example, the operations of the method 1300 may be performed by an apparatus, such as a gun or a device that is capable of being affixed to a gun. In some examples, a processor (or a controller or an event manager) may execute a set of instructions to control the functional elements of the apparatus to perform the described functions. Additionally or alternatively, the apparatus may perform aspects of the described functions using special-purpose hardware.

At step 1305, an apparatus may measure, at a sensor of the apparatus, motion of the apparatus along multiple axes. Measuring motion of the apparatus may include measuring the velocity of the apparatus, the acceleration of the apparatus, the orientation of the apparatus, the location of the apparatus, or any combination thereof.

At step 1310, the apparatus may identify a gun event based on the measured motion of the apparatus satisfying a motion condition, where the motion condition comprises an acceleration threshold. As an example, the apparatus may identify the gun event based on a measured linear acceleration along a first axis exceeding a linear acceleration threshold for the first axis. As another example, the apparatus may identify the gun event based on a measured angular acceleration along a second axis exceeding an angular acceleration threshold for the second axis. As yet another example, the apparatus may identify the gun event based on (i) the measured linear acceleration along the first axis exceeding the linear acceleration threshold for the first axis; and (ii) the measured angular acceleration along the second axis exceeding the angular acceleration threshold for the second axis.

At step 1315, the apparatus may transmit, based on the measured motion of the apparatus satisfying the motion condition, an electrical signal indicating the gun event. In response to the electrical signal, the apparatus may update a shot count and/or a round count. As an example, the apparatus may increment the shot count in response to the electrical signal indicating the gun event. As another example, the apparatus may decrement the round count in response to the electrical signal indicating the gun event.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Figure 14:
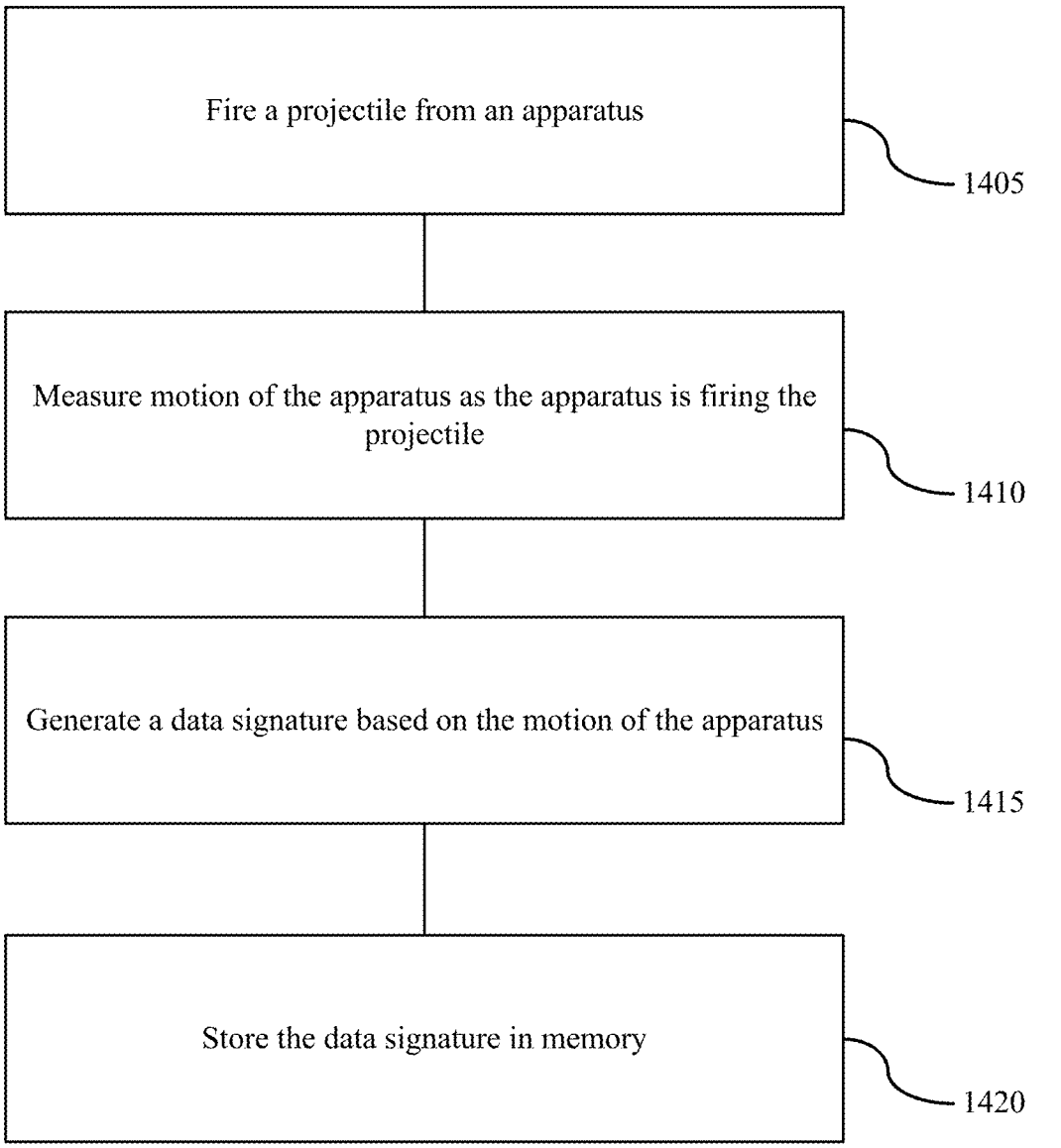
FIG. 14 illustrates an example of a flowchart showing a method of configuring an apparatus with a data signature.

FIG. 14 shows a flowchart illustrating a method 1400 of configuring an apparatus with a data signature. The operations of the method 1400 may be implemented by a gun or a device that is capable of being affixed to a gun. For example, the operations of the method 1400 may be performed by an apparatus, such as a gun or a device that is capable of being affixed to a gun. In some examples, a processor (or a controller or an event manager) may execute a set of instructions to control the functional elements of the apparatus to perform the described functions. Additionally or alternatively, the apparatus may perform aspects of the described functions using special-purpose hardware.

At step 1405, an apparatus may fire a projectile. For example, the projectile may be a bullet, and the bullet may be fired through a barrel of the apparatus.

At step 1410, the apparatus may measure, at a sensor of the apparatus, motion of the apparatus as the apparatus is firing the projectile. The sensor may measure motion of the sensor and the sensor may be stably affixed to the apparatus such that motion of the sensor indicates motion of the apparatus. In some examples, the apparatus may be a gun that is capable of identifying gun events.

At step 1415, the apparatus may generate the data signature based on the motion of the apparatus, where the data signature comprises a threshold value that is based on the motion of the apparatus measured as the apparatus is firing the projectile. The threshold value may include a peak velocity or a peak acceleration. For example, the threshold value may include a peak linear acceleration and/or a peak angular acceleration. In some examples, the threshold value may be discounted by a percentage, and a motion condition may be satisfied based on measured motion of the apparatus being greater than or equal to the discounted threshold value.

At step 1420, the apparatus may store the data signature in memory of the apparatus. The memory may be an example of volatile memory or non-volatile memory, and the memory may be embedded in the apparatus. For example, the memory may be located within a gun (e.g., under the barrel and forward of the trigger guard, under the grip, etc.) or within a device that is capable of being affixed to a gun.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Examples

Several aspects of the present disclosure are set forth examples. Note that, unless otherwise specified, all of these examples can be combined with one another. Accordingly, while a feature may be described in the context of a given example, the feature may be similarly applicable to other examples.

In some examples, the techniques described herein relate to a method performed by a gun, the method including: transmitting an electrical signal to an actuator, so as to cause displacement of the actuator that results in a projectile being propelled through a barrel of the gun; obtaining data that is representative of measurements of motion of the gun, as measured by a sensor in real time along multiple axes; parsing the data to discover one or more measurements that are indicative of an event that results in a predictable amount of motion or direction of motion; confirming that the one or more measurements are generated by the sensor within a threshold duration of the electrical signal being transmitted to the actuator; and storing an indication of the event in memory.

In some examples, the techniques described herein relate to a method performed by a gun, the method including: transmitting, from a capacitor bank to an actuator, an electrical signal so as to cause displacement of the actuator; propelling, based on transmitting the electrical signal to the actuator, a projectile through a barrel of the gun, wherein propelling the projectile causes motion of the gun; measuring, based on the transmitting the electrical signal to the actuator, the motion of the gun for a time duration; determining that the motion of the gun satisfies a similarity condition with a motion signature associated with the gun, wherein the motion of the gun satisfies the similarity condition based on a measured acceleration value exceeding a threshold acceleration value of the motion signature; and storing, based on the motion of the gun satisfying the similarity condition, an indication that the projectile has been propelled through the barrel.

In some examples, the techniques described herein relate to a method, further including: identifying a trigger break based on a trigger displacement threshold being satisfied, wherein the electrical signal is transmitted in response to the trigger break.

In some examples, the techniques described herein relate to a method performed by a gun, the method including: measuring, at a sensor of the gun, motion of the gun along multiple axes; identifying a gun event based on the measured motion of the gun satisfying a motion condition, wherein the motion condition includes an acceleration threshold; and transmitting, based on the measured motion of the gun satisfying the motion condition, an electrical signal indicating the gun event.

In some examples, the techniques described herein relate to a method, further including: transmitting, based on the gun event, an additional electrical signal to reset a charging circuit of the gun, wherein the gun event corresponds to a nominal gun event.

In some examples, the techniques described herein relate to a method, further including: transmitting, based on the gun event, an additional electrical signal to transition the gun into a safe state that prevents the gun from firing, wherein the gun event corresponds to an anomalous gun event.

In some examples, the techniques described herein relate to a method, further including: identifying a first event within a time duration of the gun event, wherein the transmitting the electrical signal is further based on the identifying the first event within the time duration of the gun event.

In some examples, the techniques described herein relate to a method, wherein the first event includes a mechanical trigger break, a trigger signal indicating a trigger break, or a first motion event.

In some examples, the techniques described herein relate to a method, wherein the time duration is inclusively between 10 milliseconds and 100 milliseconds.

In some examples, the techniques described herein relate to a method, wherein the acceleration threshold includes a linear acceleration value for a first axis.

In some examples, the techniques described herein relate to a method, wherein the acceleration threshold includes an angular acceleration value for a second axis, or wherein the motion condition includes an angular velocity value for the second axis.

In some examples, the techniques described herein relate to a method, wherein the transmitting the electrical signal includes: transmitting an interrupt signal from the sensor to a processor of the gun, wherein the processor stores an indication of the gun event in response to the interrupt signal.

In some examples, the techniques described herein relate to a method, further including: storing the measured motion of the gun in a data buffer, wherein the data buffer contains at least a threshold amount of memory.

In some examples, the techniques described herein relate to a method, wherein the threshold amount of memory is capable of storing data measured along at least one axis of the multiple axes and across a time duration ranging inclusively between 25 milliseconds and 250 milliseconds.

In some examples, the techniques described herein relate to a method, wherein the measured motion of the gun saturates at least one axis of the multiple axes.

In some examples, the techniques described herein relate to a method, further including: displaying, at a user interface and in response to the gun event, a shot count indicating a number of shots fired by the gun, wherein the user interface is coupled with the gun or a gun docking station.

In some examples, the techniques described herein relate to a method, further including: displaying, at a user interface and in response to the gun event, a shot count indicating a number of rounds present in the gun, wherein the user interface is coupled with the gun or a gun docking station.

In some examples, the techniques described herein relate to a method, further including: storing, based on the motion condition being satisfied, the measured motion of the gun along the multiple axes and an indication of the gun event.

In some examples, the techniques described herein relate to a method, wherein the indication of the gun event includes data indicating a type of gun event.

In some examples, the techniques described herein relate to an apparatus including: memory containing a data signature defining a threshold for an axis or defining multiple thresholds for multiple respective axes, wherein the data signature represents motion of the apparatus that is expected in response to firing a projectile; a sensor configured to measure motion along multiple axes and generate an output indicating the measured motion of the apparatus; and a processor configured to generate an indication of a gun event based on comparing the output of the sensor to the data signature and determining that the measured motion of the apparatus matches motion of the apparatus that is expected in response to a gunshot.

In some examples, the techniques described herein relate to an apparatus, wherein the processor is further configured to: identify a trigger event including a mechanical trigger break or an electrical signal indicating a trigger break, wherein the indication of the gun event is further based on the trigger event.

In some examples, the techniques described herein relate to an apparatus, wherein the processor is further configured to: update a data structure stored in the memory based on the indication of the gun event, wherein the data structure indicates a number of rounds present in a gun or a number of rounds that have been fired.

In some examples, the techniques described herein relate to an apparatus, wherein the sensor is coupled with the processor, and wherein the sensor includes an inertial measurements unit, an accelerometer, a gyroscope, a magnetometer, or any combination thereof.

In some examples, the techniques described herein relate to a method of configuring an apparatus with a data signature, the method including: firing a projectile from a gun; measuring, at a sensor of the gun, motion of the gun as the gun is firing the projectile; generating the data signature based on the motion of the gun, wherein the data signature includes a threshold value that is based on the motion of the gun measured as the gun is firing the projectile; and storing the data signature in memory of the apparatus.

In some examples, the techniques described herein relate to a method, further including: performing multiple iterations of: firing an additional projectile from the gun; and for each iteration of the multiple iterations, measuring, at the sensor of the gun, motion of the gun associated with firing the respective additional projectile from the gun.

In some examples, the techniques described herein relate to a method, further including: applying a function to the measured motion of the gun, wherein the function yields an average value or a median value.

In some examples, the techniques described herein relate to a method, further including: discounting the threshold value, wherein discounting the threshold value includes reducing the threshold value by a discrete value or a percentage.

In some examples, the techniques described herein relate to a method, wherein the data signature includes an additional threshold value corresponding to an additional axis, and wherein the threshold value corresponds to an axis.

In some examples, the techniques described herein relate to a method, wherein the data signature includes an orientation of the gun.

In some examples, the techniques described herein relate to a method, further including: storing the data signature in additional memory of an additional gun, wherein the gun is associated with a characteristic and the additional gun is associated with the characteristic.

In some examples, the techniques described herein relate to a method, wherein the characteristic includes a cartridge caliber, a gun weight, a gun geometry, or any combination thereof.

In some examples, the techniques described herein relate to a method, further including: firing an additional projectile from an additional gun; measuring, at an additional sensor of the additional gun, motion of the additional gun associated with firing the additional projectile from the additional gun; generating an additional data signature based on the motion of the additional gun, wherein the additional data signature includes an additional threshold value; and storing the additional data signature in memory.

In some examples, the techniques described herein relate to a method, wherein the gun is associated with a first characteristic and the additional gun is associated with a second characteristic that is different from the first characteristic.

In some examples, the techniques described herein relate to a method, wherein the first characteristic includes a cartridge caliber, a gun weight, a gun geometry, or any combination thereof.

In some examples, the techniques described herein relate to a method, the method including: transmitting, from a capacitor bank to an actuator including a solenoid, an electrical signal such that the electrical signal causes the actuator to be displaced, causing a projectile to be propelled through a barrel based on the transmitting the electrical signal, where propelling the projectile results in motion of the gun, measuring the motion of the gun for a time duration based on transmitting the electrical signal, determining that the motion of the gun satisfies a similarity condition with a motion signature associated with the gun, and storing, based on the motion of the gun satisfying the similarity condition, an indication that the projectile has been propelled through the barrel.

Remarks

The Detailed Description provided herein, in connection with the drawings, describes example configurations and does not represent all the examples that may be implemented or that are within the scope of the claims. The term "example" used herein means "serving as an illustration or instance," and not "a preferred example."

The functions described herein may be implemented with a controller. A controller may include an event manager, a special-purpose processor, a general-purpose processor, a DSP, a CPU, a graphics processing unit (GPU), a microprocessor, a tensor processing unit (TPU), a neural processing unit (NPU), an image signal processor (ISP), a hardware security module (HSM), an ASIC, a programmable logic device (such as an FPGA), a state machine, a circuit (such as a circuit including discrete hardware components, analog components, or digital components), or any combination thereof. Some aspects of a controller may be programmable, while other aspects of a control may not be programmable. In some examples, a digital component of a controller may be programmable (such as a CPU), and in some other examples, an analog component of a controller may not be programmable (such as a differential amplifier).

In some cases, instructions or code for the functions described herein may be stored on or transmitted over a computer-readable medium, and components implementing the functions may be physically located at various locations. Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a special-purpose processor, a general-purpose processor, a manager, or a controller. A computer-readable media may include any combination of the above, and a compute component may include computer-readable media.

In the context of the specification, the term "left" means the left side of the gun when the gun is held in an upright position, where the term "upright position" generally refers to a scenario in which the gun is oriented as if in a high-ready position with the barrel roughly parallel to the ground. The term "right" means the right side of the gun when the gun is held in the upright position. The term "front" means the muzzle end (also referred to as the "distal end") of the gun, and the term "back" means the grip end (also referred to as the "proximal end") of the gun. The terms "top" and "bottom" mean the top and bottom of the gun as the gun is held in the upright position. The relative positioning terms such as "left," "right," "front," and "rear" are used to describe the relative position of components. The relative positioning terms are not intended to be limiting relative to a gravitational orientation, as the relative positioning terms are intended to be understood in relation to other components of the gun, in the context of the drawings, or in the context of the upright position described above.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. A method performed by a gun, the method comprising:

identifying a firing event that is intended to cause the gun to fire;

measuring, at a sensor of the gun, acceleration data along multiple axes, wherein the acceleration data is collected in a buffer of the gun for a predetermined amount of time;

analyzing the acceleration data to determine whether an acceleration threshold is satisfied during the predetermined amount of time subsequent to the firing event, wherein the acceleration threshold represents a nominal discharge of a projectile from the gun;

identifying a misfire event based on the acceleration threshold not being satisfied during the predetermined amount of time subsequent to the firing event;

storing an indication of the misfire event in non-volatile memory of the gun, wherein the indication of the misfire event includes the acceleration data and a timestamp indicating an approximate time at which the misfire event occurred; and displaying, in response to the misfire event, an alert indicating that a malfunction has occurred.

2. A method performed by a gun, the method comprising:

identifying a firing event that is intended to cause the gun to fire;

measuring, at a sensor of the gun, acceleration data along multiple axes, wherein the acceleration data is collected in a buffer of the gun for a predetermined amount of time;

analyzing the acceleration data to determine whether an acceleration threshold is satisfied during the predetermined amount of time subsequent to the firing event, wherein the acceleration threshold represents a nominal discharge of a projectile from the gun;

identifying an anomalous gun event based on the acceleration threshold not being satisfied during the predetermined amount of time subsequent to the firing event;

storing an indication of the anomalous gun event in non-volatile memory of the gun; and displaying, in response to the anomalous gun event, an alert indicating that a malfunction has occurred.

3. The method of claim 2, wherein the alert includes a red flashing light.

4. A method performed by a gun, the method comprising:

identifying a firing event that is intended to cause the gun to fire;

measuring, at a sensor of the gun, acceleration data along multiple axes, wherein the acceleration data is collected in a buffer of the gun for a predetermined amount of time;

analyzing the acceleration data to determine whether an acceleration threshold is satisfied during the predetermined amount of time subsequent to the firing event, wherein the acceleration threshold represents a nominal discharge of a projectile from the gun;

identifying an anomalous gun event based on the acceleration threshold not being satisfied during the predetermined amount of time subsequent to the firing event;

storing an indication of the anomalous gun event in non-volatile memory of the gun; and generating, in response to the anomalous gun event, an audible alert indicating that a malfunction has occurred.

5. A method performed by a gun, the method comprising:

identifying a firing event that is intended to cause the gun to fire;

measuring, at a sensor of the gun, acceleration data along multiple axes, wherein the acceleration data is collected in a buffer of the gun for a predetermined amount of time;

analyzing the acceleration data to determine whether an acceleration threshold is satisfied during the predetermined amount of time subsequent to the firing event, wherein the acceleration threshold represents a nominal discharge of a projectile from the gun;

identifying an anomalous gun event based on the acceleration threshold not being satisfied during the predetermined amount of time subsequent to the firing event;

storing an indication of the anomalous gun event in non-volatile memory of the gun;

generating an error log based on the indication of the anomalous gun event; and storing the error log in non-volatile memory of the gun.

6. A method performed by a gun, the method comprising:

identifying a firing event that is intended to cause the gun to fire;

measuring, at a sensor of the gun, acceleration data along multiple axes, wherein the acceleration data is collected in a buffer of the gun for a predetermined amount of time;

analyzing the acceleration data to determine whether an acceleration threshold is satisfied during the predetermined amount of time subsequent to the firing event, wherein the acceleration threshold represents a nominal discharge of a projectile from the gun;

identifying an anomalous gun event based on the acceleration threshold not being satisfied during the predetermined amount of time subsequent to the firing event;

storing an indication of the anomalous gun event in non-volatile memory of the gun; and generating a data structure that includes data associated with the anomalous gun event, wherein the storing the indication of the anomalous gun event in the non-volatile memory includes storing the data structure in the non-volatile memory.

7. The method of claim 2, further comprising:

generating a data structure that includes the acceleration data, wherein the storing the indication of the anomalous gun event in the non-volatile memory includes storing the data structure in the non-volatile memory.

8. A method performed by a gun, the method comprising:

identifying a firing event that is intended to cause the gun to fire;

measuring, at a sensor of the gun, acceleration data along multiple axes, wherein the acceleration data is collected in a buffer of the gun for a predetermined amount of time;

analyzing the acceleration data to determine whether an acceleration threshold is satisfied during the predetermined amount of time subsequent to the firing event, wherein the acceleration threshold represents a nominal discharge of a projectile from the gun;

identifying an anomalous gun event based on the acceleration threshold not being satisfied during the predetermined amount of time subsequent to the firing event;

storing an indication of the anomalous gun event in non-volatile memory of the gun; and generating a data structure that includes a timestamp representing approximately when the anomalous gun event occurred, wherein the storing the indication of the anomalous gun event in the non-volatile memory includes storing the data structure in the non-volatile memory.

9. An apparatus comprising:

memory containing an acceleration threshold for an axis, wherein the acceleration threshold represents motion of the apparatus that is expected in response to firing a projectile;

a sensor configured to measure motion along multiple axes and generate an output indicating the measured motion of the apparatus; and a processor configured to:

identify an anomalous gun event based on acceleration data failing to satisfy the acceleration threshold for a predetermined amount of time following a firing event, wherein the firing event includes generating an electrical signal that is intended to cause the apparatus to fire a projectile, and generate a data structure containing information related to the anomalous gun event.

10. The apparatus of claim 9, wherein the acceleration threshold corresponds to acceleration of the apparatus that is expected in response to a gunshot.

11. The apparatus of claim 9, wherein the processor is further configured to:

store the data structure in the memory.

12. The apparatus of claim 9, wherein the processor is further configured to:

determine a temperature measurement based on an output of a temperature sensor of the apparatus; and include the temperature measurement in the data structure.

13. The apparatus of claim 9, wherein the processor is further configured to:

include the acceleration data in the data structure.

14. An apparatus comprising:

memory containing an acceleration threshold for an axis, wherein the acceleration threshold represents motion of the apparatus that is expected in response to firing a projectile;

a sensor configured to measure motion along multiple axes and generate an output indicating the measured motion of the apparatus; and a processor configured to:

identify an anomalous gun event based on acceleration data failing to satisfy the acceleration threshold for a predetermined amount of time following a firing event, generate a data structure containing information related to the anomalous gun event, and include a timestamp in the data structure, wherein the timestamp indicates an approximate time at which the anomalous gun event occurred.

* * * * *